US012661542B2

(12) United States Patent
Wickramasekera

(10) Patent No.: US 12,661,542 B2
(45) Date of Patent: Jun. 23, 2026

(54) PORTABLE CLIMBING NET

(71) Applicant: Outlier Campers LLC, Cambridge, MA (US)

(72) Inventor: Ananda Wickramasekera, Cambridge, MA (US)

(73) Assignee: Outlier Campers LLC, Cambridge, MA (US)

( * ) Notice: Subject to any disclaimer, the term of this patent is extended or adjusted under 35 U.S.C. 154(b) by 49 days.

(21) Appl. No.: 18/754,874

(22) Filed: Jun. 26, 2024

(65) Prior Publication Data

US 2025/0025730 A1 Jan. 23, 2025

Related U.S. Application Data

(60) Provisional application No. 63/514,265, filed on Jul. 18, 2023.

(51) Int. Cl.
*A63B 9/00* (2006.01)
*A63B 71/02* (2006.01)

(52) U.S. Cl.
CPC ..... *A63B 9/00* (2013.01); *A63B 71/023* (2013.01); *A63B 2009/002* (2013.01); *A63B 2210/50* (2013.01)

(58) Field of Classification Search
CPC ..... A63B 9/00; A63B 2009/002; E06C 1/08; E06C 1/10; E06C 1/383; E06C 7/48
USPC ..... 182/195
See application file for complete search history.

(56) References Cited

U.S. PATENT DOCUMENTS 1,488,244 A * 3/1924 Hinton ..... A63B 9/00 482/36
3,008,711 A * 11/1961 Dillon ..... A63B 9/00 D21/826
4,521,016 A * 6/1985 Tominaga ..... A63B 69/0084 473/430

(Continued)

FOREIGN PATENT DOCUMENTS

CN 2482438 3/2002
CN 201710902 1/2011

(Continued)

OTHER PUBLICATIONS

Monkey Gym, "expandable pole with climbing net," Retrieved online: <https://monkey-gym.com/categories/expandable-pole/expandable-pole-with-climbing-net/>, 4 pages.

(Continued)

*Primary Examiner* — Joshua T Kennedy
(74) *Attorney, Agent, or Firm* — SOLID STATE LAW FIRM PLLC

(57) ABSTRACT

A collapsible portable climbing net, featuring a left and right lateral pole, each comprising separable or connectable segments. The top pole connects the upper segments of the lateral poles, while the bottom pole connects the lower segments. A net is secured between the lateral poles and the top and bottom poles. The design allows for folding the lateral poles for compact storage, passing the poles through collars for easy assembly, and includes additional segments connected by connectors. The top and bottom poles are pivotally connected, enabling the net to be folded compactly.

17 Claims, 12 Drawing Sheets

(56) References Cited

U.S. PATENT DOCUMENTS

| | | | | |
|---|---|---|---|---|
| 5,040,791 | A * | 8/1991 | Ratajac | A63B 69/0084 473/426 |
| 5,326,337 | A * | 7/1994 | Pardella | A63B 9/00 403/49 |
| 5,407,211 | A * | 4/1995 | Bottiglieri | A63B 69/0097 473/421 |
| 8,430,205 | B2 * | 4/2013 | Leung | E04H 4/144 182/180.1 |
| 10,758,803 | B2 | 9/2020 | Morse | |
| 11,305,168 | B2 | 4/2022 | Smith | |
| 2004/0222043 | A1 * | 11/2004 | Fortner | E06C 1/10 182/178.3 |
| 2018/0093135 | A1 * | 4/2018 | Roberts | A63B 71/02 |
| 2021/0101061 | A1 | 4/2021 | Pell et al. | |
| 2022/0168605 | A1 * | 6/2022 | Janicki | A63B 9/00 |
| 2025/0082977 | A1 * | 3/2025 | Andon | A63B 9/00 |

FOREIGN PATENT DOCUMENTS

| | | | | |
|---|---|---|---|---|
| CN | 203598438 | | 5/2014 | |
| CN | 209405573 | | 9/2019 | |
| CN | 209984844 | | 1/2020 | |
| CN | 209984844 | U * | 1/2020 | |
| CN | 211245331 | | 8/2020 | |
| CN | 211836052 | | 11/2020 | |
| CN | 212141281 | | 12/2020 | |
| CN | 212308736 | | 1/2021 | |
| CN | 214436114 | | 10/2021 | |
| CN | 214596980 | | 11/2021 | |
| CN | 217794475 | | 11/2022 | |
| CN | 218793710 | | 4/2023 | |
| CN | 219011889 | | 5/2023 | |
| CN | 118557938 | A * | 8/2024 | A63B 71/022 |
| DE | 102006043555 | A1 * | 3/2008 | E06C 1/10 |

OTHER PUBLICATIONS

Bloon Toys, "Transformable Pikler Triangle Collection," Retrieved online: <https://bloontoys.com/collections/bloon-pikler-collection?gclid=EAIaIQobChMIpvfqjvb0_wIVDKqWCh3rZQM1EAMYASAAEgLImPD_BWE>, 11 pages.

* cited by examiner

PORTABLE CLIMBING NET

CROSS-REFERENCE TO RELATED APPLICATION

This application claims the benefit of U.S. Provisional Patent Application No. 63/514,265, filed in the United States Patent and Trademark Office on Jul. 18, 2023, the entire contents of which are incorporated herein by reference.

BACKGROUND

Technical Field

The present disclosure relates to collapsible portable climbing nets. Specifically, it pertains to climbing nets that feature lateral poles with separable or connectable segments, top and bottom poles connecting these lateral segments, and a net secured between the poles. The design allows for easy folding, compact storage, and straightforward assembly, making the climbing nets suitable for portable applications and convenient transportation.

Background

Described herein is a portable climbing net that is a net used for climbing enclosed by a collapsible, foldable, and/or disconnectable/detachable rigid frame on four sides that can be rolled, folded, and/or otherwise collapsed making it substantially more compact for storage and transportation and is safer for children and adults to use.

Telescoping ladders, portable folding ladders (i.e., ladders that fold in half or more laterally, as opposed to self-supporting, A-framed, folding ladders or step stools for home or workspace use), portable extending ladders (i.e., ladders with sections that may extend to roughly double the collapsed length) that are designed for portability, such as for use with rooftop tents, rooftop campers, or to access roofs and roof racks of recreational vehicles, campers, camping trailers, vehicles, or for other uses where portability is important, although more compact than traditional ladders (including those that fold or extend), still take up a significant amount of trunk or storage space. Telescoping, portable folding (in half), or portable extending ladders may be as much as a half or a third as long when collapsed as when they are extended but are typically the same width when collapsed, making them cumbersome to store inside some vehicle trunks, particularly when full of other items, inside closed rooftop tents or rooftop campers, or in other places where storage space is limited.

The wider a telescoping, portable folding, or portable extending ladder is, the safer and more comfortable it is for climbing however, the more space it will take up when stored, since the rungs are typically rigid and not foldable or collapsible such that the ladder width is not reduced when collapsed. The narrower the telescoping, portable folding, or portable extending ladder is, the easier it is to store. However, it offers less climbing width making it less safe and comfortable for use.

Furthermore, most portable telescoping, folding, or extending ladders are designed for adult use with rung spacing that is often too great for children, particularly younger children, and have handrails and rung thicknesses that may be too large for smaller hands (e.g., the hands of smaller children) to fully grasp. When used to enter or exit a rooftop tent or rooftop camper, children may find it difficult to climb up or down these ladders because: they have to search for the rung below or above, which may be too far and even more difficult to do in the dark; they may not be able to fully grasp thicker rungs or rails; rigid rungs may be more slippery, particularly in the rain; or standing on rigid rungs without sturdy shoes on may be dangerous, uncomfortable, and/or painful. Many of the same reasons that make portable telescoping, folding (laterally in half), and extending ladders used for camping less safe for children, may also make them less safe for adults.

A safer alternative to ladders may be climbing nets, similar to those often found on children's playgrounds, made of taut netting that is easier to grip for small children, has closer spacing making it easier for smaller children to navigate, offers plenty of spaces (e.g., squares between longitudinal and lateral straps) to securely place hands and feet, and provides a wide climbing surface. Climbing nets found on playgrounds are often fixed to or framed by rigid, permanent structures made of metal, wood, and/or plastic and are therefore not portable or suitable for use while camping.

It would be beneficial for climbing nets that are easier and safer for children and adults to use, such as those found on playgrounds, to be combined with a rigid frame that may be collapsible for portability and/or storage in the trunk of a vehicle or inside a collapsed rooftop tent or rooftop camper. Each longitudinal side rail of the portable climbing net may be configured to fold into two, three, or more sections, and/or telescope; and the lateral top and bottom rails may be disconnectable/detachable, foldable (i.e., into two or more sections or foldable against one of the longitudinal rails), and/or capable of telescoping, making the climbing device collapsible along both its length and width into a substantially smaller bundle that may be easier for storage than a portable telescoping, folding, or extending rigid ladder.

Because the portable climbing net may be collapsible laterally as well as longitudinally, as compared with portable telescoping, folding, and extending ladders that are collapsible only along their length, a portable climbing net may also be configured to be substantially wider than a typical portable ladder, making it even more safe for children and adults to use. For example, a portable climbing net with a net surrounded by a rigid, collapsible frame, when extended, unfolded, and/or assembled for use, may be configured to be about 2 to 3 feet wide, or more or less, wide, compared to widths of about 1 to 1.5 feet for typical portable ladders.

For rooftop tents, the portable climbing net may be configured to span the majority of, the entire width of, or may be wider than the door opening (which may be about 2 to 3 feet, or more or less, wide) of many rooftop tents and rooftop campers, such that little to no portion of the opening is not covered by a climbing surface below it, making it significantly safer for use than a typical telescoping, folding, or extending ladder.

A portable climbing net is safer for children and adults to use because: spacing is closer; it is easier to grip the softer, smaller net strapping by hand and foot than it would be with rigid ladder rungs; there are many more places to place feet and hands during climbing; hands and feet placed on the net will be more secure because the net provides squares, compared with wide rungs, limiting slippage both vertically and horizontally; the net's strapping may offer a better and more comfortable grip with or without shoes; and it may be configured to offer a substantially wider climbing surface.

A portable climbing net that is collapsible along both its length and width, offering greater portability, is safer for children and adults, and has a more comfortable climbing surface as compared with rigid, portable ladders typically used for camping, is described herein.

Campers, camping trailers, travel trailers, teardrop trailers, roof top tents, roof top campers, caravans, recreational vehicles, motor homes, van conversions, and "tiny homes" collectively referred to herein as "campers" or passenger vehicles, such as cars, sport utility vehicles, pickups, station wagons, vans, or other passenger vehicles, collectively referred to herein as "vehicles" offer limited space to store portable, rigid, telescoping, folding, or extending ladders, collectively referred to herein as "collapsible, rigid ladders" that may be required for accessing roof racks or elevated sleeping areas.

Telescoping ladders often have several sections of the side rails that can be collapsed into the section below it until the last section is reached or telescoped out of a lower section to expand the ladder for use at variable heights, depending on how many sections are expanded. Each section of the side rails often contain a fixed rung between them that lowers or rises as the section collapses or expands. The result is a compressed ladder that may be about roughly one third, or more or less, of its expanded height. These ladders are however, typically about 1.5 feet wide (give or take a few inches) in either collapsed configuration or expanded configuration.

Folding ladders that may be folded laterally roughly halfway along their entire length (as opposed to self-supporting folding ladders or foot stools for home or workspace use that may form an "A" shape when unfolded) may be collapsible such that their stored length is roughly one half of the length of their extended use, making them portable for use during camping however, since their collapsed width remains the same, they are still cumbersome to store in vehicle trunks or campers, particularly campers that themselves requiring collapsing for storage and/or transportation. Some of these ladders may fold into more than two sections, in which case they may be shorter than one half of the extended length when collapsed, but their width may still remain the same when collapsed.

Extending ladders with roughly equal sized sections that may slide up or down to extend the ladder for use, may be roughly one half of the entire length, when collapsed or less than one half the entire length when collapsed if they have more than two extendable sections. However, like telescoping and folding ladders, these ladders are still as wide in collapsed configuration as they are in expanded configuration, still making them cumbersome to store in trunks or collapsed rooftop tents and rooftop campers. Some ladders may be foldable or collapsible longitudinally (i.e., folded lengthwise in roughly half at about midpoint along each rung), in which case, they may greatly reduce their stored width, but their stored height may be the same or even greater, making them even more difficult to store in a vehicle trunk or collapsed rooftop tent or rooftop camper.

For example, some ladders may have rungs that fold in half, and when folded, the left and right side rails may be brought closer together, significantly reducing the ladder's width, however the ladder may not be foldable in half or more in order to reduce the length, and in some cases, the folded top rung may add additional height above the length of the side rails, possibly even increasing the stored ladder's length. Ladders that have foldable rungs rather than handrails may be too long for use in car camping, because a typical length of 6 to 8 or more feet may be much too long for storage inside most vehicles and collapsed rooftop tents and campers.

Even if the collapsible, rigid ladders described above may be stored during transportation for camping use, they have other disadvantages, particularly for children and smaller adults. These ladders are often designed for use by average sized adults with rung spacing that may be too great for children to reach and/or may have rung and rail thicknesses that may be too large for children or some adults to fully wrap their smaller hands around. Rigid ladder rungs may also be slippery when wet and may be uncomfortable or improper for use without shoes. For camping, a user may wish to take his or her shoes off prior to climbing the ladder or while on the ladder, prior to entering the camper to store them inside shoes bags often attached to the exterior of the camper. Climbing a collapsible, rigid ladder or taking shoes off while standing on one may be uncomfortable or dangerous and extreme caution would need to be exercised. Because most rigid ladders cannot reduce their width when collapsed for storage or transportation, they're often just about 1 to 1.5 feet wide, give or take a few inches. Many rooftop tent or rooftop camper openings may be 2 to 3 feet wide, or more or less. Typically collapsible, rigid ladders used with rooftop tents or rooftop campers may leave some or a lot of space on either side of the ladder, below the door opening, where a person may accidentally put their foot when attempting to exit the camper. If a person extends their foot out of the opening to reach a ladder rung, but misses the ladder, there is potential for a fall. These collapsible, rigid ladders become even more dangerous to use at night when visibility is limited. If a person is inebriated, climbing or descending a collapsible, rigid ladder becomes even more dangerous.

It would be beneficial for a climbing apparatus, used particularly for camping, such as to access rooftop tents, rooftop campers, or roof racks on campers and vehicles that is both easier to store in confined spaces, and safer for adults and children to use than collapsible, rigid ladders. It would be beneficial for a climbing apparatus to be stowable inside a vehicle trunk, pickup bed, closed collapsible campers (e.g., rooftop tents and rooftop campers), or in other confined spaces by having a climbing surface that is made of a highly flexible material, such as nylon, rope, or some other strong and flexible strapping materials and a frame that is comprised of rigid components that may be collapsible, foldable, capable of telescoping, and/or detachable such that they may be reorganized for storage in a manner that may allow it to collapse into a much smaller size and/or shape when stored (e.g., as compared to its expanded size); makes efficient use of and/or conforms to the available storage space (e.g., rolled up into a relatively slender bundle, folded into a relatively flat configuration, or laid as flat as possible to rest above and/or below other items); and/or have some components that may be separable, if needed, for storage in various locations.

It would further be beneficial, if a highly stowable and portable climbing apparatus could also be safer for children and adults to use, particularly while camping, when there might be reduced visibility at night; Children and adults might use the ladder at night or in the morning, when they're sleepy or may have just woken up from sleep and/or when adults are inebriated. It would be beneficial if a climbing apparatus is easier to grip, particularly for smaller children and adults; has smaller spacing for shorter legs and hands; has multiple positions both vertically and horizontally to place hands and feet, with limited chances of slipping downwards or sideways; retains grip when wet; and is wide enough to span most of the width, all of the width, or is wider than an opening to an elevated camper.

The portable climbing net described herein is compact enough when collapsed for storage inside a vehicle trunk or inside a camper, including campers that collapse and is safer and more comfortable for use, particularly with campers that are elevated or to access the roofs and/or roof racks of vehicles or campers as compared with collapsible ladders. The portable climbing net is comprised of a strong yet flexible climbing net material and a strong, rigid, frame material making it highly compact, when stored, as well as much safer to use than traditional collapsible, rigid ladders with rungs.

Because the portable climbing net's rigid frame materials may be comprised mainly of slender poles, pipes, and/or tubes, and may be folded, collapsed, telescoped, and/or separated, they may be combined, pushed together, reorganized, or stored in various locations. And because the portable climbing net's climbing surface is comprised mainly of a softer, more flexible, net material, the rigid components may be rolled inside it; it may be bunched up between the rigid components, if those are simply pushed together; it may be laid flat taking up very little vertical space and because it's made of a strong netting material, like those used in cargo nets, heavy objects may be laid on top of it, without causing damage, or it may be draped over other objects, without causing damage to those objects; and/or the netting may be separated from some or all of the rigid components for storage in different locations.

Depending on how many sections the portions of the frame that may comprise the longer handrails on each side have (e.g., two, three, or more), the frame may collapse into either a longer, slimmer profile, or a shorter, thicker profile, when the rigid portions of the frame are compiled into a bundle for storage. The net may conform around, be bunched up within, or separated from that bundle for storage. Depending on the size of the bundle, the portable climbing net may be stored in duffle-type bag that is either long and slim or short and thick. Alternatively, the rigid and net components may be folded and/or separated and laid relatively flat for storage inside a relatively flat case. Or the components of the portable climbing net may simply be stored loosely inside a vehicle trunk, inside a closed, collapsible camper, or inside any other confined space.

Using netting the same as or like those found on climbing apparatuses on children's playgrounds or used in gyms for recreation, the portable climbing net is safer for use by children and adults as compared with collapsible, rigid ladders. The softer netting provides straps that are easier for smaller hands to grasp and more comfortable to stand on, with or without shoes, and whether wet or not, as compared with thick, wide, rigid ladder rungs. The netting also provides longitudinal straps that, along with the lateral straps, form multiple square sections to place hands and feet on that may also prevent sideways slippage in addition to downward slippage. The spacing between lateral straps may also be shorter than typical ladder rung spacing, making it easier for children and/or adults with shorter legs to climb and descend. Because the portable climbing net may also pack down significantly smaller than its expanded size, it could be made wider than collapsible, rigid ladders, offering a climbing surface with greater surface area.

Having a climbing surface that is as almost as wide, as wide, or wider than an elevated camper opening (e.g., the door or opening of a rooftop tent or rooftop camper) may be safer since more of the door opening is covered by the climbing apparatus, such that there is a wider surface to stand on or turn around on when entering or exiting the camper. The portable climbing net may also simply be more intuitive for children to use, including very young ones, because they may be used to similar netting found on climbing apparatuses at school playgrounds.

SUMMARY OF THE INVENTION

The portable climbing net is comprised of a strong, weight-bearing, flexible net that is made of nylon, polyester, ropes, cords, cables, or other strapping or strong, flexible net materials which is framed by sections of rigid poles, pipes, and/or tubes made of aluminum, other metal, plastic, wood, composite materials, and/or other suitable, rigid materials, or a combination of materials that may collapse, fold, or separate into smaller components for storage.

Because the portable climbing net is comprised of foldable or detachable, rigid pole, pipe, and/or tube components that comprise the frame and a flexible climbing net, the collapsed climbing apparatus may be stored in many configurations to fit various storage spaces. For example, the rigid components may be rolled into the net, forming a long and narrow bundle; the rigid components may simply be pushed together such that the net is bunched up between or among them; the net and rigid components may be folded together laterally one or more times to occupy a relatively flat yet wide space or longitudinally to occupy a relatively flat yet long space; the net and rigid components may be laid flat without folding or bunching, taking up little height, allowing objects to be placed on top of the net; all or portions of the net may be draped over other objects (e.g., objects in the trunk of a vehicle); and/or portions may be completely separated for storage in various areas.

Because the collapsed portable climbing net is comprised of long and relatively thin rigid materials and a loose, flexible net, it may conform to the available space where it may be stored. A portable climbing net may have a frame composed of two side rails, one on each side of the net, which may fold or separate into two or more sections for storage. The net may be like cargo or climbing nets commonly available, with overlapping longitudinal and lateral straps, ropes, cords, cables, and/or other strong, yet flexible materials which may or may not form loops on each end.

If the net is made of a relatively flat strapping material, like nylon or polyester strapping or other similar, relatively flat, strapping materials, the ends of each lateral and/or longitudinal strap may be folded over and stitched or otherwise permanently fixed such that they form a closed loop on each end of the strap through which components of a rigid frame may be passed. Alternatively, if the net is made of rope, cord, cable, or other materials that may or may not be relatively flat, each end of each longitudinal column and/or lateral row may be similarly folded over and stitched, tied, clamped, or otherwise permanently fixed such that each end has a closed loop through which a frame may be passed.

The side rails may fit through the loops on either side of a net, as described above. The cargo net may be fastened through one or more loops or have one or more loops tied or otherwise fixed to the side rails, for a permanent attachment to the side rails and so that the side rails do not slip out of the net's loops during disassembly for storage or while stored and/or so that the net may not slip down the side rails while positioning or positioned for use; or the net's loops may only loosely fit around the side rails when stored and may be snug around the frame and held securely in position, when it is expanded for use since the frame may pull the net taut in both the longitudinal and lateral directions. Alternatively, or in addition, the net along its side edges and/or loops may be clipped to, strapped to, or otherwise attached to the side rails either before or after the rigid frame is positioned for use.

A top and bottom rail that completes the frame of the climbing net may either be separate components that are attachable to and detachable from both side rails, or the top and bottom rails may be hinged to and foldable against one of the side rails and attachable to and detachable from the opposite side rail. The top and bottom rails may slip through the loops at the top and bottom of the cargo or climbing net and attached to each of the side rails to expand the portable climbing net for use. Alternatively or in addition, the net along its top and bottom edges and/or loops may be clipped to, strapped to, or otherwise attached to the top and bottom rails, respectively, either before or after those rails are attached to the side rails and positioned for use.

When the left and right side rails are unfolded and/or connected and locked in position, if necessary, and attached through or to the left and right sides, respectively, of the net or otherwise firmly attached to the left and right sides, respectively, of the net, and the top and bottom rails are firmly attached between the side rails and through or to the top and bottom, respectively, of the net or otherwise firmly attached to the top and bottom, respectively, of the net, the rigid frame around the perimeter of the climbing net may cause the climbing net to be taut in both the longitudinal and lateral directions. A taut net, when stretched, pulled, or fully expanded, may be easier to climb than a loose net.

Hooks at or near the top of each side rail or on the top rail may allow attachment to ladder brackets on rooftop tents, rooftop campers, vehicle sides, or vehicle roofs; or may allow the portable climbing net to hook on to the rails of vehicle roof racks, vehicle rain gutters, or other structures, features, or components that may accommodate hooks. Alternatively, the portable climbing net may have other features on or near the top of the side rails or on the top rail that may allow attachment to corresponding features, if necessary, on a rooftop tent, rooftop camper, roof rack, vehicle, or other suitable structure, such as brackets, pins, nuts and bolts, screws, clips, latches, straps or other mechanisms that may allow for temporary attachment of a portable climbing net to a suitable structure. Pivoting feet at the bottom of each side rail may allow for firm placement on the ground such that the feet may remain relatively level with the ground, while the ladder is slanted at an angle toward a camper, vehicle, or other structure, when positioned for climbing or the feet may be pivoted so that they're as flat against the side rail for storage.

To expand the portable climbing net for use, a person may need to unroll, lay out, spread out, or otherwise reposition or reorganize the components for expansion or assembly for use. Then, the side rails, which may each be attached to a loose net through the loops on either side of the net, may be unfolded and locked into position, if the hinges between pole, pipe, or tube sections have or require a locking hinge. It may be possible for side rails that fold into two sections to be unfolded in such a manner that they do not require locking, particularly when they fold only on the bottom facing side of the portable climbing net (i.e., the side opposite of the side that a person may stand or climb on), such that a person's weight on the frame and/or the weight of the portable climbing net itself may prevent the portable climbing net from accidentally folding (i.e., it may only be foldable in the upward direction and not the downward direction).

Alternatively, if the side rail sections are telescoping, they may be extended or if they're in smaller, detachable sections, they be attached to form a longer side rail section. If the top and bottom rails are completely detachable components, they may be slipped through the loops in the top and bottom of the net, that may be like the loops on the sides of the net through which the side rails pass through, as is the case with many cargo and climbing nets currently available with loops on all four sides, which may be portions of the netting that are folded over and permanently stitched or otherwise fixed at the ends forming a closed loop on each end of each strap of the net, as previously mentioned. Once the top or bottom rails are passed through the loops at the top or bottom of the net, respectively, they each may be securely fastened to the side rails.

Alternatively, if the top and bottom rails are each hingedly connected to one side rail, they may be moved or repositioned from a stored position where they may be folded against and relatively parallel with the side rail to which they are fixed so that that they may now be unfolded and relatively perpendicular to the side rail to which they are fixed and may be latched or otherwise fastened to the opposite side rail. In this configuration, once the top and bottom rails are attached to both side rails, the net, along the top and bottom, respectively, either through loops or along the top and bottom edges, respectively, may be clipped, strapped, or otherwise attached to the top and bottom rails, respectively. In either configuration (i.e., if the top and bottom rails are fully attachable/detachable to/from both side rails or are attachable/detachable to/from one side rail and hingedly connected to another side rail), once both the top and bottom rails are securely positioned between each of the side rails, the top, bottom, and side rails together form a rigid, four-sided frame stretching or expanding the net and causing it to be taut in both the longitudinal and lateral directions.

Some of the steps to set up the portable climbing net, in either configuration (i.e., if the top and bottom rails are fully attachable/detachable to/from both side rails or are attachable/detachable to/from one side rail and hingedly connected to another side rail), may be interchangeable such that the top and bottom rails may first be positioned between the folded side rails and then the side rails together may be unfolded (e.g., as a book might be unfolded) and locked, if necessary, into position. Once the frame of the portable climbing net is fully assembled with the net expanded between the frame, the portable climbing net may then be positioned with its feet on the ground and slanted toward a structure, such as a vehicle, camper, or other object that may support the portable climbing net as a ladder may be supported.

If the portable climbing net has hooks on or near the top of the side rails or on the top rail, those hooks may hook onto brackets on a vehicle, vehicle roof rack, camper, camper roof rack, or other suitable structure. Alternatively, the portable climbing net may have other features on or near the top of the side rails or on the top rail that may allow attachment to corresponding features, if required and present, on a rooftop tent, rooftop camper, roof rack, vehicle, or other suitable structure, such as brackets, pins, nuts and bolts, screws, clips, latches, straps or other mechanisms that may allow for temporary attachment of a portable climbing net to a suitable structure. Or the portable climbing net, whether it has hooks or other features on or near the top of the side rails or on the top rail or not, may simply be made to rest near its top edge against the side or top of a vehicle, vehicle roof rack, camper, camper roof rack, or other suitable structure, like many ladders may be positioned for use.

Once positioned for use (i.e., with feet placed firmly on the ground or another suitable surface and the top of the portable climbing net hooked or otherwise attached to or safely resting against an elevated surface), an adult or child may place their hands and feet onto portions of the straps, ropes, cords, or other materials that make up the net and form square, rectangular, diamond-shaped, or other shaped spaces in the net that may be created by overlapping longitudinal and lateral or opposing diagonal straps, ropes, cords, or other materials, and ascend or descend the portable climbing net. The square, rectangular, diamond-shaped, or other shaped open sections may form a much more secure surface for adults and children to climb by limiting slippage from side to side as well as downward, as opposed to rigid, wide ladder rungs. Numerous square, rectangular, diamond-shaped, or other shaped open sections to place hands and feet may configured to be closer together than ladder rungs, making it easier and safer for shorter adults and/or children to climb. Average or taller adults may easily skip rows of open spaces on the portable climbing net, if they wish, to ascend the net faster.

Furthermore, the thinner, softer straps or other materials of the net may be easier and more comfortable to grasp for smaller adult or child hands as compared with thicker, rigid ladder rungs. The softer, flexible straps or other materials of the climbing net may be more comfortable, as compared with rigid ladder rungs, for climbers that are not wearing shoes, because ladder rungs may cause too much firm pressure to be concentrated on a small part of a person's foot or feet, as a person without shoes stands on or climbs it. The softer, flexible straps or other materials of the net may also be less slippery compared with rigid ladder rungs, particularly when wet.

Often, when exiting a rooftop tent or camper, a person may enter a ladder facing away from it then turn around on the ladder to descend it. Or, when entering a rooftop tent or camper, a person may wish to ascend it and just prior to entering the camper, remove their shoes while still on the ladder and place them in a shoe bag next to the ladder, as is often done when entering rooftop tents or campers. A person may also descend or ascend a ladder backwards if they entered the ladder that way and do not wish to or cannot turn around. These methods of entering, exiting, or climbing up or down a ladder may be more dangerous on a ladder than on the portable climbing net described herein. The portable climbing net may offer a wider climbing surface with more sections to place hands and feet that have straps or other materials that may be easier to grasp and/or stand on to turn around, remove shoes, or even ascend or descend backwards.

Should an adult or child accidentally slip on the portable climbing net, there may be more and easier opportunities to catch a nearby longitudinal, lateral, or diagonal strap, as compared with the rigid ladder rungs and handrails should the same thing happen on a ladder, so that they can stabilize themselves and may prevent completely falling off the portable climbing net. Furthermore, falling on or accidentally hitting any part of the net portion (which makes up most of the surface area) of the portable climbing net may hurt significantly less or not at all, as compared with a rigid ladder.

To collapse the portable climbing net for storage, the top and bottom rails may be completely disconnected from the side rails and pulled out of the top and bottom loops, respectively, of the net. Alternatively, if the top and bottom rails are each latched (or otherwise temporarily fixed or fastened) to one side rail and hingedly (or pivotally) connected to another side rail and if they are clipped, strapped or otherwise attached to the top and bottom, respectively, of the net, they may be unclipped, unstrapped, or otherwise detached from the top and bottom, respectively, of the net then unlatched (or otherwise disconnected or unfastened) from the side rail to which they may each be latched (or temporarily connected or fastened) to and folded against the side rail to which they each may be hingedly (or pivotally) connected to.

Once the top and bottom rails are disconnected and separate or the top and bottom rails are each folded against a side rail, each side rail may then be folded in half or more, if there are more than 2 foldable sections. Alternatively, the side rails may be capable of telescoping and maybe compressible into a shorter section or capable of completely separating into smaller components. Some of the steps to collapse the portable climbing net, in either lateral rail configuration (i.e., if the top and bottom rails are fully attachable/detachable to/from both side rails or are attachable/detachable to/from one side rail and hingedly connected to another side rail), may be interchangeable such that the side rails may first be unlocked, if necessary, and folded (e.g., as a book might be folded) (or alternatively compressed or separated) then the top and bottom rails may be detached and separated from the side rails if they are completely detachable from both side rails or detached and folded if they are detachable from one side rail and hingedly connected to the other side rail. With the top and bottom rails disconnected and loose or folded against a side rail, and each side rail folded, compressed, or separated, the rigid frame pieces of the portable climbing net may then be pushed together, bunching the net between them, may be rolled into the net, or may be laid flat or folded with the net and placed on, over, under, or around other objects for storage or may be stored inside a duffle bag or case.

With top and bottom rails that may fully detach from both side rails or may detach from one side rail and be foldable against the other side rail, and with the side rails that may be foldable, compressible, or separable into smaller sections, the rigid frame components of the portable climbing net may be collapsed into smaller, relatively thin sections that, together with a flexible climbing or cargo net, may have a stored length and width that is significantly less than its length and width when the portable climbing net is expanded for use as compared with collapsible, rigid ladders that are either collapsible along either their length or their width but typically not both.

In some embodiments, a collapsible portable climbing net is provided. The collapsible portable climbing net may include a left longitudinal pole comprising a first longitudinal pole and a second longitudinal pole; a right longitudinal pole comprising a third longitudinal pole and a fourth longitudinal pole; a top pole connecting the first longitudinal pole and the third longitudinal pole; a bottom pole connecting the second longitudinal pole and the fourth longitudinal pole; and a net secured between the left longitudinal pole and the right longitudinal pole and between the top pole and the bottom pole. In a collapsed configuration, the first longitudinal pole and the third longitudinal pole are configured to be folded against the second longitudinal pole and the fourth longitudinal pole, respectively.

Preferably, the top pole detachably may connect the first longitudinal pole and the third longitudinal pole by connectors. Similarly, the bottom pole may detachably connect the second longitudinal pole and the fourth longitudinal pole by connectors. Preferably, the top pole may be pivotably connected to the left longitudinal pole by a hinge. Similarly, the bottom pole is pivotably connected to the right longitudinal pole by a hinge. In the collapsed configuration, the first longitudinal pole and the third longitudinal pole may be configured to be partially or completely folded against the second longitudinal pole and the fourth longitudinal pole, respectively.

Hooks may be connected to the left longitudinal pole and the right longitudinal pole, respectively. Foots may be connected to the left longitudinal pole and the right longitudinal pole, respectively. The top pole may be configured to vary length by a top collar. Similarly, the bottom pole is configured to vary length by a bottom collar. A foot pole may be connected to the left longitudinal pole and the right longitudinal pole, respectively. Alternatively, two foot poles may be connected to the left longitudinal pole and the right longitudinal pole, respectively.

The net may be secured to the top pole by a strap. Similarly, the net may be secured to the bottom pole by a strap. The first longitudinal pole and the second longitudinal pole may be connected by a hinge or a connector. Similarly, the third longitudinal pole and the fourth longitudinal pole are connected by a hinge or a connector.

In some embodiments, a collapsible portable climbing net is provided. The collapsible portable net may include a left longitudinal pole comprising a first longitudinal pole and a second longitudinal pole, the first longitudinal pole and the second longitudinal pole being connected by a hinge; a right longitudinal pole comprising a third longitudinal pole and a fourth longitudinal pole, the third longitudinal pole and the fourth longitudinal pole being connected by a hinge; a top pole detachably connecting the first longitudinal pole and the third longitudinal pole; a bottom pole detachably connecting the second longitudinal pole and the fourth longitudinal pole; and a net secured between the left longitudinal pole and the right longitudinal pole and between the top pole and the bottom pole. In a collapsed configuration, the first longitudinal pole and the third longitudinal pole may be configured to be folded against the second longitudinal pole and the fourth longitudinal pole, respectively. Preferably, foots may be connected to the left longitudinal pole and the right longitudinal pole, respectively.

In some embodiments, a collapsible portable climbing net includes a left longitudinal pole comprising a first longitudinal pole, a second longitudinal pole, and a third longitudinal pole, the first longitudinal pole and the second longitudinal pole being connected by a connector, and the second longitudinal pole and the third longitudinal pole being connected by a connector; a right longitudinal pole comprising a fourth longitudinal pole, a fifth longitudinal pole, and a sixth longitudinal pole, the fourth longitudinal pole and the fifth longitudinal pole being connected by a connector, and the fifth longitudinal pole and the sixth longitudinal pole being connected by a connector; a top pole pivotally connected to the left longitudinal pole; a bottom pole pivotally connected to the right longitudinal pole; and a net secured between the left longitudinal pole and the right longitudinal pole and secured to the top pole and the bottom pole by straps. In a collapsed configuration, the first longitudinal pole and the third longitudinal pole are configured to be folded against the second longitudinal pole; and the fourth longitudinal pole and the sixth longitudinal pole are configured to be folded against the fifth longitudinal pole. Preferably, foots may be connected to the left longitudinal pole and the right longitudinal pole, respectively. Preferably, two foot poles may be connected to the left longitudinal pole and the right longitudinal pole, respectively.

In some embodiments, a collapsible portable climbing net is provided. The collapsible portable net may include a left longitudinal pole comprising a first longitudinal pole and a second longitudinal pole, the first longitudinal pole and the second longitudinal pole being connected by a connector; a right longitudinal pole comprising a third longitudinal pole and a fourth longitudinal pole, the third longitudinal pole and the fourth longitudinal pole being connected by a connector; a top pole detachably connecting the first longitudinal pole and the third longitudinal pole; a bottom pole detachably connecting the second longitudinal pole and the fourth longitudinal pole; and a net secured between the left longitudinal pole and the right longitudinal pole and between the top pole and the bottom pole. In a collapsed configuration, the first longitudinal pole and the third longitudinal pole may be configured to be separated from the second longitudinal pole and the fourth longitudinal pole, respectively. Preferably, foots may be connected to the left longitudinal pole and the right longitudinal pole, respectively.

In some embodiments, a collapsible portable climbing net includes a left longitudinal pole comprising a first longitudinal pole, a second longitudinal pole, and a third longitudinal pole, the first longitudinal pole and the second longitudinal pole being connected by a connector, and the second longitudinal pole and the third longitudinal pole being connected by a connector; a right longitudinal pole comprising a fourth longitudinal pole, a fifth longitudinal pole, and a sixth longitudinal pole, the fourth longitudinal pole and the fifth longitudinal pole being connected by a connector, and the fifth longitudinal pole and the sixth longitudinal pole being connected by a connector; a top pole pivotally connected to the left longitudinal pole; a bottom pole pivotally connected to the right longitudinal pole; and a net secured between the left longitudinal pole and the right longitudinal pole and secured to the top pole and the bottom pole by straps. In a collapsed configuration, the first longitudinal pole and the third longitudinal pole are configured to be separated from the second longitudinal pole; and the fourth longitudinal pole and the sixth longitudinal pole are configured to be separated from the fifth longitudinal pole. Preferably, foots may be connected to the left longitudinal pole and the right longitudinal pole, respectively. Preferably, two foot poles may be connected to the left longitudinal pole and the right longitudinal pole, respectively.

In some embodiments, a collapsible portable climbing net is provided. The climbing net includes a left lateral pole comprising a first lateral pole and a second lateral pole, the first lateral pole and the second lateral pole being separable from each other; a right lateral pole comprising a third lateral pole and a fourth lateral pole, the third lateral pole and the fourth lateral pole being separable from each other; a top pole comprising a first collar and a second collar; a bottom pole comprising a third collar and a fourth collar; and a net secured between the left lateral pole and the right lateral pole and between the top pole and the bottom pole. The first lateral pole is configured to pass through the first collar, and the third lateral pole is configured to pass through the second collar, and wherein the second lateral pole is configured to pass through the third collar, and the fourth lateral pole is configured to pass through the fourth collar.

The net may include at least one loop that is configured to be passed through by at least one of the first lateral pole, the second lateral pole, the third lateral pole, and the fourth lateral pole.

Figure 1:
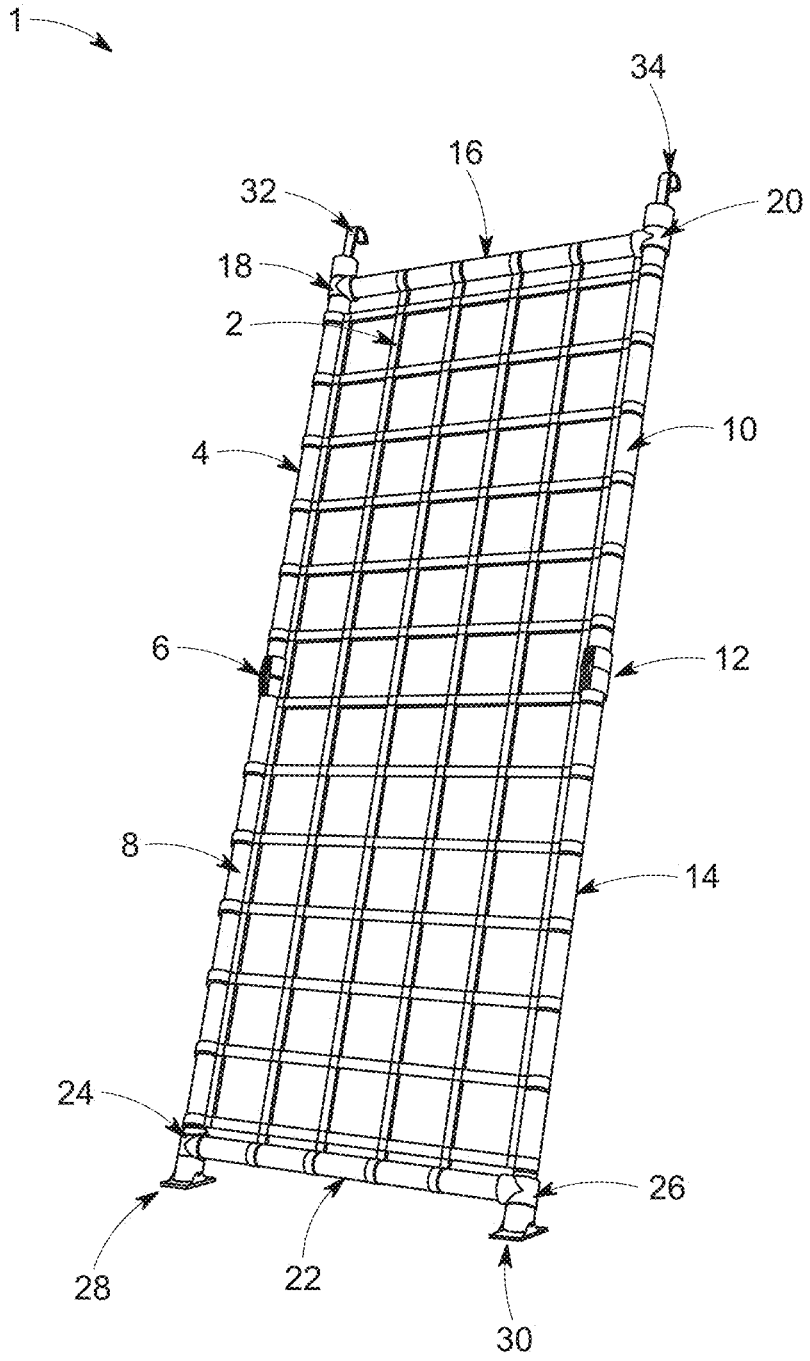
FIG. 1 shows a prospective view of an exemplary portable climbing net in an expanded configuration.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Described herein are devices, components, assemblies, systems, methods, etc. for universal surface accessory mounts. The description and accompanying figures, which describe and show certain embodiments, are made to demonstrate, in a non-limiting manner, several possible configurations of universal surface accessory mounts, apparatuses, components, assemblies, systems, etc. and various methods of using them according to various aspects and features of the present disclosure. Accordingly, the disclosure is not limited to the specific embodiments described. Rather, the inventive principles associated with the embodiments described herein, including with respect to the apparatuses, devices, components, assemblies, systems, methods, etc. described herein, may be applied in a variety of ways, including to other types of apparatuses, devices, components, assemblies, systems, methods, etc. General and specific apparatuses, devices, components, assemblies, systems, methods, etc. are described herein sufficiently to enable one to develop a variety of implementations/applications without undue experimentation. In the development of particular applications, numerous implementation-specific decisions will be made to achieve the design-specific goals, which will vary from one implementation/application to another. It will be appreciated that, having access to this disclosure and reading this disclosure, such a development effort would be a routine undertaking for persons of ordinary skill in the art.

This document does not intend to distinguish between components that differ in name but not function. In the following discussion and in the claims, the terms "including," "includes," "comprising," "have," and "has" are used in an open-ended fashion, and thus should be interpreted to mean "including, but not limited to." The word "or" is used in the inclusive sense (i.e., "and/or") unless a specific use to the contrary is explicitly stated.

FIG. 1 shows a prospective view of exemplary portable climbing net 1 in an expanded configuration for use. As shown in FIG. 1, portable climbing net 1 may be comprised of net 2, which may be like a cargo or climbing net, and components of a rigid, collapsible frame. Net 2 may be made of a strong yet flexible material commonly used in climbing and/or cargo nets and cargo straps such as nylon, polyester, Dyneema, Kevlar, plastic, rope, cables, and/or other suitable materials. As further shown in FIG. 1, the rigid frame of portable climbing net 1 may have a side rail or handrail on one side (i.e., the left side) which is comprised of pole 4, hinge 6, and pole 8; and another side rail or handrail on an opposite side (i.e., the right side) comprised of pole 10, hinge 12, and pole 14. Pole 16 may comprise a top rail of portable climbing net 1 which may be fastened to or by connector 18 on pole 4 and connector 20 on pole 10, as shown in FIG. 1. Pole 22 may comprise a bottom rail of portable climbing net 1 which may be fastened to or by connector 24 on pole 8 and connector 26 on pole 14, as shown in FIG. 1. Poles 4, 8, 10, 14, 16, and 22 may be made of aluminum, steel, other metal, plastic, fiberglass, carbon fiber, other composite materials, wood, or other materials, or a combination of materials. Poles 4, 8, 10, 14, 16, and 22 may be solid, hollow, or have a combination of solid and hollow portions; and may be round, square, rectangular, triangular, or may be some other shape or combination of shapes. Poles 4, 8, 10, 14, 16, and 22 may each have threads, holes, notches, protrusions, and/or other features located internally or externally toward one or both ends that may fit into, onto, or otherwise attach to corresponding threads, holes, notches, protrusions and/or other features located internally or externally toward one or both ends on an adjacent pole and/or connector on an adjacent pole that may allow quick attachment to and quick detachment from that pole and/or connector on that pole. Some or all of the pole, pipe, or tube components that comprise the rigid frame of portable climbing net 1 may be connected through and/or to some or all loops at the ends of columns and rows of net 2 or at or along other parts of net 2 by use of fasteners through grommets on net 2 (e.g., fastened to the side rails of portable climbing net 1), zip ties, ties, clamps, clips, carabiners, chain links, straps, cables, or by other methods of attaching the flexible net portion to the rigid frame, and/or they may simply slip through loops at the ends of each column and row of net 2 without being fixed (e.g., the side, top and/or bottom rails may pass through closed loops in the net). Whether some or all of the rigid frame components of portable climbing net 1 are permanently or semi-permanently fastened to net 2, not fastened at all and simply slipped through the loops in net 2, or some portions are fastened while other portions are not fastened, when all portions of the rigid frame of portable climbing net 1 are connected, unfolded, expanded, or otherwise positioned for use, net 2 may be stretched, expanded, or otherwise positioned for use as a climbing surface and portable climbing net 1 will be configured for use as shown in FIG. 1.

As shown in FIG. 1, connectors 18, 20, 24, and 26 may contain some or all portions of brackets, pins, screws, holes, clamps, threaded collars, internal or external threads, and/or other components or combination of components that may be used to quickly connect one pole, pipe, or tube perpendicularly to another pole, pipe, or tube for use or to quickly disconnect one pole, pipe, or tube from another pole, pipe, or tube for storage. Connectors 18 and 20 may have some or all components located on poles 4 and 10, respectively, which may comprise the upper portion of the side rails of portable climbing net 1; connectors 18 and 20 may have some or all components located on pole 16, which may comprise the top rail of portable climbing net 1; or connector 18 may have portions located on poles 4 and 16, and/or connector 20 may have portions located on poles 10 and 16. Some or all portions of connectors 18 and 20 may be fastened to poles 4, 10, and/or 16 by pins, screws, threaded collars, adhesive, welding, and/or another fastening mechanism; connectors 18 and 20 may be screwed directly onto or into poles 4, 10, and/or 16 (i.e., connectors 18 and 20 may have internal or external threads that may be capable of screwing onto or into corresponding threads on poles 4, 10, and/or 16); or some or all portions of connectors 18 and 20 may be integrated portions of poles 4, 10, and/or 16 (e.g., they may be protrusions from or sections of the poles themselves, or may be the internal or external threads on each pole capable of being screwed into or out of corresponding threads on the pole(s) to which they connect to). Connectors 18 and 20 may temporarily connect poles 4 and 10, respectively, to pole 16 (i.e., when portable climbing net 1 is expanded for use) and may be used to disconnect poles 4 and 10, respectively, from pole 16 (i.e., when portable climbing net 1 is collapsed for storage) by use of pins, screws, clamps, latches, threaded collars, by the action of screwing onto or into poles and unscrewing from poles, and/or another mechanism or method that may be used to make quick connections and disconnections. Connectors 24 and 26 may have some or all components located on poles 8 and 14, respectively, which may comprise the lower portion of the side rails of portable climbing net 1; connectors 24 and 26 may have some or all components located on pole 22, which may comprise the bottom rail of portable climbing net 1; or connector 24 may have portions located on poles 8 and 22, and/or connector 26 may have portions located on poles 14 and 22. Some or all portions of connectors 24 and 26 may be fastened to poles 8, 14, and/or 22 by pins, screws, threaded collars, adhesive, welding, and/or another fastening mechanism; connectors 24 and 26 may be screwed directly onto or into poles 8, 14, and/or 22 (i.e., connectors 24 and 26 may have internal or external threads that may be capable of screwing onto or into corresponding threads on poles 8, 14, and/or 22); or some or all portions of connectors 24 and 26 may be integrated portions of poles 8, 14, and/or 22 (e.g., they may be protrusions from or sections of the poles themselves, or may be the internal or external threads on each pole capable of being screwed into or out of corresponding threads on the pole(s) to which they connect to). Connectors 24 and 26 may temporarily connect poles 8 and 14, respectively, to pole 22 (i.e., when portable climbing net 1 is expanded for use) and may be used to disconnect poles 8 and 14, respectively, from pole 22 (i.e., when portable climbing net 1 is collapsed for storage) by use of pins, screws, clamps, latches, threaded collars, by the action of screwing onto or into poles and unscrewing from poles, and/or another mechanism or method that may be used to make quick connections and disconnections.

Figure 2:
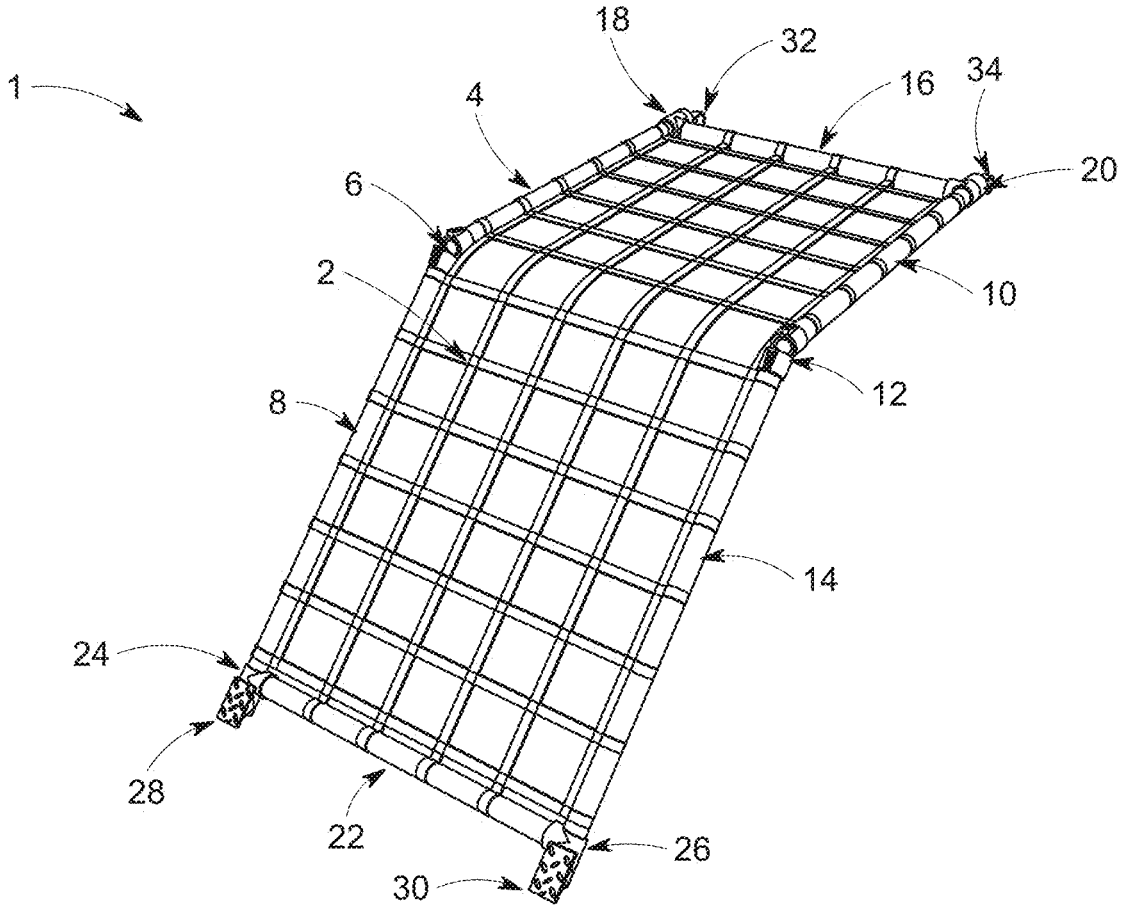
FIG. 2 shows a prospective view of an exemplary portable climbing net in a first transition from an expanded configuration to a collapsed configuration.
Figure 3:
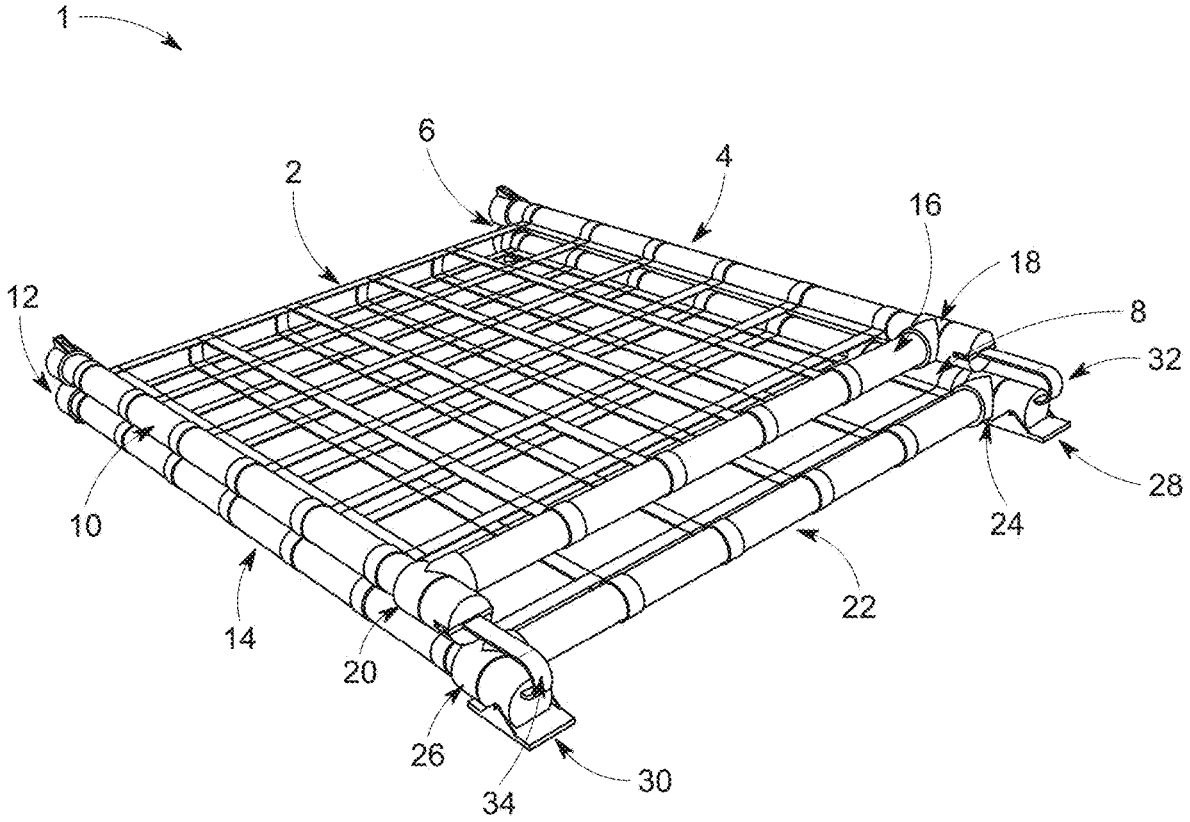
FIG. 3 shows a prospective view of an exemplary portable climbing net in a second transition from an expanded configuration to a collapsed configuration.
Figure 4:
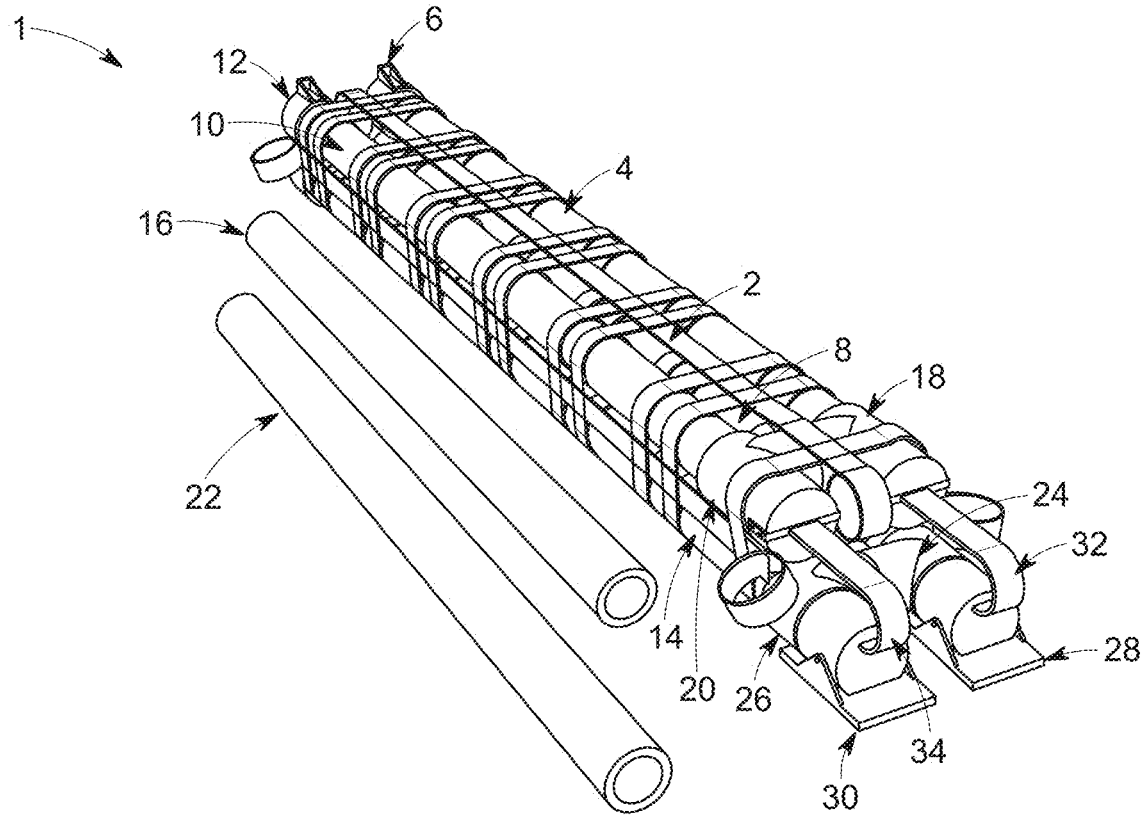
FIG. 4 shows a prospective view of an exemplary portable climbing net in a collapsed configuration.

As shown in FIG. 1, hinge 6 may be a hinge that connects pole 4 to pole 8 in a manner that may allow pole 4 to be connected in line with pole 8 for unfolding and use of portable climbing net 1 or may allow poles 4 and 8 to be folded against each other, as shown in transition in FIG. 2 and shown fully folded in FIGS. 3 and 4, to facilitate collapsing of portable climbing net 1 for storage. Hinge 6 may be permanently or semi-permanently attached to both poles 4 and 8 (e.g., by screws, pins, threaded collars, adhesive, welding, may be screwed directly onto or into the poles by use of internal or external threads that correspond to threads on the poles, or another fastening mechanism) and may be similar to commonly available pole hinges used to connect one pole, pipe, or tube to another pole, pipe, or tube. When opened or folded, hinge 6 may allow poles 4 and 8 to fold against each other as shown in transition in FIG. 2 and shown fully folded in FIGS. 3 and 4. Hinge 6 may be a locking hinge that, when closed or unfolded and latched, may prevent the hinge from opening or folding and therefore keeping poles 4 and 8 securely unfolded and in line with each other, as shown in FIG. 1, such that weight applied to the top of the hinge and/or poles (e.g., by a person standing or climbing on portable climbing net 1) or by force applied to the bottom of the hinge (e.g., by a person bumping up against the bottom of portable climbing net 1 or otherwise accidentally applying a force to the bottom of the hinge) may not cause the poles to fold (e.g., in an unwanted manner). When unlatched (e.g., for storage), poles 4 and 8 may be folded against each other, as shown in transition in FIG. 2 and shown fully folded in FIGS. 3 and 4, to collapse the left side rail of portable climbing net 1. Alternatively, hinge 6 may be a non-locking hinge that allows folding in only one direction such that if a force was applied to the top of the hinge and poles (e.g., by a person standing or climbing on portable climbing net 1), the hinge may remain closed or unfolded with the poles in an unfolded position, in line with each other, as shown in FIG. 1, yet when force is applied to the bottom of the hinge (e.g., by hand to fold it for storage), it may open or fold and allow poles 4 and 8 to fold against each other, as shown in transition in FIG. 2 and shown fully folded in FIGS. 3 and 4. Similarly and as also shown in FIG. 1, hinge 12 may be a hinge that connects pole 10 to pole 14 in a manner that may allow pole 10 to be connected in line with pole 14 for unfolding and use of portable climbing net 1 or may allow poles 10 and 14 to be folded against each other, as shown in transition in FIG. 2 and shown fully folded in FIGS. 3 and 4, to facilitate collapsing of portable climbing net 1 for storage. Hinge 12 may be permanently or semi-permanently attached to both poles 10 and 14 (e.g., by screws, pins, threaded collars, adhesive, welding, may be screwed directly onto or into the poles by use of internal or external threads that may be screwed onto or into corresponding threads on the poles, or another fastening mechanism) and may be similar to commonly available pole hinges used to connect one pole, pipe, or tube to another pole, pipe, or tube. When opened or folded, hinge 12 may allow poles 10 and 14 to fold against each other as shown in transition in FIG. 2 and shown fully folded in FIGS. 3 and 4. Hinge 12 may be a locking hinge that, when closed or unfolded and latched, may prevent the hinge from opening or folding and therefore keeping poles 10 and 14 securely unfolded and in line with each other, as shown in FIG. 1, such that weight applied to the top of the hinge and/or poles (e.g., by a person standing or climbing on portable climbing net 1) or by force applied to the bottom of the hinge (e.g., by a person bumping up against the bottom of portable climbing net 1 or otherwise accidentally applying a force to the bottom of the hinge) may not cause the poles to fold (e.g., in an unwanted manner). When unlatched (e.g., for storage), poles 10 and 14 may be folded against each other, as shown in transition in FIG. 2 and shown fully folded in FIGS. 3 and 4, to collapse the right side rail of portable climbing net 1. Alternatively, hinge 12 may be a non-locking hinge that allows folding in only one direction such that if a force was applied to the top of the hinge and poles (e.g., by a person standing or climbing on portable climbing net 1), the hinge may remain closed or unfolded with the poles in an unfolded position, in line with each other, as shown in FIG. 1, yet when force is applied to the bottom of the hinge (e.g., by hand to fold it for storage), it may open or fold and allow poles 10 and 14 to fold against each other, as shown in transition in FIG. 2 and shown fully folded in FIGS. 3 and 4. Hinges 6 and 12 may be comprised of metal, plastic, fiberglass, carbon fiber, other composite materials, other materials, or some combination of materials.

Alternatively, hinges 6 and 12 may not be hinges at all but, may be configured to be connectors just like the connectors described above (i.e., connectors 18, 20, 24, and 26) capable of connecting pole 4 to pole 8 and connecting pole 10 to pole 14, respectively, where the pole sections that make up each side rail or handrail are not attached to each other when stored and may be connected together for use. For example, hinge 6 may be a connector (e.g., connector 6) that connects pole 4 to pole 8 for use and disconnects them for storage. Similarly, hinge 12 may be a connector (e.g., connector 12) that connects pole 10 to pole 14 for use and disconnects them for storage. If hinges 6 and 12 are alternatively configured as connectors (e.g., as connectors 6 and 12, respectively), they may have some or all of the same properties, features, and components of the connectors previously described (i.e., connectors 18, 20, 24, and 26). If some or all of poles 4, 8, 10, and/or 14 are not fastened to any of the loops at the ends of each row of net 2 (i.e., they slip through the closed loops of net 2 but are not fastened to them), those poles that are not fastened to net 2 may be capable of being freely turned to screw into or out of the pole to which they connect to expand a side rail or handrail of portable climbing net 1 for use or disconnect the poles that make up a side rail or handrail of portable climbing net 1 for storage (e.g., hinge 6, which may be configured as connector 6, may be comprised of internal or external threads on pole 4 and corresponding threads on pole 8 such that connecting pole 4 to pole 8 may comprise screwing one pole into or onto another to expand portable climbing net 1 for use and disconnecting pole 4 from pole 8 may comprise unscrewing one pole from another to collapse portable climbing net 1 for storage; and hinge 12, which may be configured as connector 12, may be comprised of internal or external threads on pole 10 and corresponding threads on pole 14 such that connecting pole 10 to pole 14 may comprise screwing one pole into or onto another to expand portable climbing net 1 for use and disconnecting pole 10 from pole 14 may comprise unscrewing one pole from another to collapse portable climbing net 1 for storage). If the poles that comprise the side rails or handrails of portable climbing net 1 are fastened or not to net 2, and if hinges 6 and 12 are configured as connectors 6 and 12, respectively, they may be engaged or connected using other connection methods described below, similar to connectors 18, 20, 24, and 26 described previously. Hinges 6 and 12, which may be configured as connectors 6 and 12, respectively, may contain some or all portions of brackets, pins, screws, holes, clamps, threaded collars, internal or external threads, and/or other components or combination of components that may be used to quickly connect one pole, pipe, or tube in line with another pole, pipe, or tube for use or to quickly disconnect one pole, pipe, or tube from another pole, pipe, or tube for storage. Connector 6, if hinge 6 is configured as a connector, may have some or all components located on pole 4, on pole 8, or on both poles. Some or all portions of connector 6, if hinge 6 is configured as a connector, may be fastened to poles 4 and/or 8 by pins, screws, threaded collars, adhesive, welding, and/or another fastening mechanism; connector 6 may be screwed directly onto or into poles 4 and/or 8 (i.e., connector 6 may have internal or external threads that may be capable of screwing onto or into corresponding threads on poles 4 and/or 8); or some or all portions of connector 6 may be integrated portions of poles 4 and/or 8 (e.g., they may be protrusions from or sections of the poles themselves, or may be the internal or external threads on each pole capable of being screwed into or out of corresponding threads on the pole(s) to which they connect to). Connector 6, if hinge 6 is configured as a connector, may temporarily connect poles 4 and 8 (i.e., when portable climbing net 1 is expanded for use) and may be used to disconnect pole 4 from pole 8 (i.e., when portable climbing net 1 is collapsed for storage) by use of pins, screws, clamps, latches, threaded collars, by the action of screwing onto or into poles and unscrewing from poles, and/or another mechanism or method that may be used to make quick connections and disconnections. Connector 12, if hinge 12 is configured as a connector, may have some or all components located on pole 10, on pole 14, or on both poles. Some or all portions of connector 12, if hinge 12 is configured as a connector, may be fastened to poles 10 and/or 14 by pins, screws, threaded collars, adhesive, welding, and/or another fastening mechanism; connector 12 may be screwed directly onto or into poles 10 and/or 14 (i.e., connector 12 may have internal or external threads that may be capable of screwing onto or into corresponding threads on poles 10 and/or 14); or some or all portions of connector 12 may be integrated portions of poles 10 and/or 14 (e.g., they may be protrusions from or sections of the poles themselves, or may be the internal or external threads on each pole capable of being screwed into or out of corresponding threads on the pole(s) to which they connect to). Connector 12, if hinge 12 is configured as a connector, may temporarily connect poles 10 and 14 (i.e., when portable climbing net 1 is expanded for use) and may be used to disconnect pole 10 from pole 14 (i.e., when portable climbing net 1 is collapsed for storage) by use of pins, screws, clamps, latches, threaded collars, by the action of screwing onto or into poles and unscrewing from poles, and/or another mechanism or method that may be used to make quick connections and disconnections.

As shown in FIG. 1, at the bottom of each side rail (i.e., the left- and right-side rails), portable climbing net 1 may contain feet that are similar to ladder feet and may be capable of pivoting or rotating to allow portable climbing net 1 to lean at various angles for use or to allow folding for storage, as shown in FIGS. 2-4. As shown in FIG. 1, foot 28 may be fastened to the bottom of pole 8, and foot 30 may be fastened to the bottom of pole 14. Feet 28 and 30 may be fastened to poles 8 and 14, respectively, by pins, screws, threaded collars, adhesive, welding, and/or another fastening method, or may be screwed directly onto or into their respective poles. Feet 28 and 30 may have a relatively flat base that may have texture, groves, or tread on the bottom to allow for a non-slip, firm, or secure placement on the ground below. Feet 28 and 30 may be comprised of metal, plastic, rubber, fiberglass, carbon fiber, other composite materials, other materials, or some combination of materials. As previously mentioned, pivoting or rotating of feet 28 and 30 relative to poles 8 and 14, respectively, may allow portable climbing net 1 to lean at various angles to achieve various climbing heights or for more or less of a slope, when in use, as shown in FIG. 1, or may also allow feet 28 and 30 to be folded flat against poles 8 and 14, respectively, for storage of portable climbing net 1, as shown in FIGS. 2-4. Feet 28 and 30 may also be height adjustable by use of a pin, spring-loaded button, or screw and various positioning holes on the shaft of feet 28 and 30, or by having feet whose height may be adjusted by screwing them into or out of the bottoms of the lower side poles of portable climbing net 1, as commonly found on many ladder or table feet and/or legs.

As shown in FIG. 1, the tops of the side rails (i.e., the left- and right-side rails) of portable climbing net 1, may contain hooks 32 and 34, respectively. Hooks 32 and 34 may be hooks to hook portable climbing 1 onto an edge of a raised surface or onto a ladder bracket on a raised surface, such as a rooftop tent or rooftop camper, a roof rack on a vehicle, or some other elevated surface. Hook 32 may be fastened to pole 4 and hook 34 may be fastened to pole 10 by pins, screws, threaded collars, adhesive, welding, or another fastening method, or each may be screwed directly onto or into their respective poles. Alternatively hooks 32 and 34 may not be curved and may instead be components capable of simply resting against an elevated surface, similar to the tops of handrails on many common ladders. Hooks 32 and 34 may be comprised of metal, plastic, rubber, fiberglass, carbon fiber, other composite materials, other materials, or some combination of materials.

With portable climbing net 1 in expanded configuration for use, as shown in FIG. 1, with the rigid frame components unfolded and connected thereby supporting, expanding, stretching, or otherwise positioning net 2 for use as a climbing surface, a person may use it to safely and securely climb up to access an elevated area such as a rooftop tent or rooftop camper, vehicle roof rack, or other elevated surface; or a person may use it to safely and securely climb down from such an area. To store portable climbing net 1, the rigid frame components may be disconnected and folded allowing net 2 to collapse, as shown in transition in FIGS. 2 and 3 and shown fully collapsed in FIG. 4.

FIG. 2 shows portable climbing net 1 in a first transition from an expanded position for use to a stored position for storage. Hinges 6 and 12 may be unlatched, if they are locking hinges and folded, or simply folded if they are not locking hinges, or disconnected if they are connectors. This may allow pole 4 to fold against pole 8 and pole 10 to fold against pole 14, as shown in transition in FIG. 2 and shown fully folded in FIG. 3. If portions of net 2 are permanently or semi-permanently connected (i.e. by use of fasteners through holes or grommets), through the loops at the ends of each row of net 2 to the side poles, poles 4, 8, 10, and 14 those portions of the net will fold as the side rails are folded. Alternatively, if side poles, poles 4, 8, 10, and 14 are simply slipped through the loops in net 2 and not fastened, the net may still fold as the side poles fold. Or if only some loops of net 2 are fastened to portions of poles 4, 8, 10, and 14 while other loops remain unfastened and are just passed over or around the poles, those portions of the net will fold as the side rails fold. With both side rails or handrails fully folded, as shown in FIG. 3, top pole 16 may be disconnected by or through connectors 18 and 20 from poles 4 and 10, respectively; and bottom pole 22 may be disconnected by or through connectors 24 and 26 from poles 8 and 14, respectively. With pole 16 disconnected from poles 4 and 10, pole 16 can slide out of the top loops of net 2 and be removed entirely, as shown in FIG. 4. Similarly, with pole 22 disconnected from poles 8 and 14, pole 22 can slide out of the bottom loops of net 2 and be removed entirely, as shown in FIG. 4. With the top pole, pole 16, and bottom pole, pole 22, completely disconnected; the side rail comprised of pole 4, hinge 6, and pole 8 folded; the side rail comprised of pole 10, hinge 12, and pole 14 folded; and foot 32 on pole 8 and foot 34 on pole 14 folded flat against their respective lower side poles, portable climbing net 1 can be collapsed, pushed together, rolled up, or otherwise compressed into a smaller bundle for storage, as shown in FIG. 4. Some or all components of portable climbing net 1 may then be strapped together, placed in a bag, and/or stored loose.

As an alternative to the steps above, the top and bottom poles, poles 16 and 22, respectively, may first be disconnected and removed, then each of the side rails may be folded for storage. Top pole, pole 16, may first be disconnected from upper side poles, poles 4 and 10, and slipped out of the top loops of net 2; then bottom pole, pole 22, may next be disconnected from the lower side poles, poles 8 and 14, and slipped out of the bottom loops of net 2. Or bottom pole, pole 22, may be first be disconnected from the lower side poles, poles 8 and 14, and slipped out of net 2; then top pole, pole 16, may be disconnected from the upper side poles, poles 4 and 10, and slipped out of net 2. Once the top and bottom poles, poles 16 and 22, respectively, are disconnected and removed, side rails, comprised of pole 4, hinge 6, and pole 8 on one side; and pole 10, hinge 12, and pole 14 on the other side may then be folded and feet 32 and 34 may be folded against their respective lower poles. With components disconnected and/or removed, portable climbing net 1 may be collapsed, pushed together, rolled up, or otherwise compressed into a smaller bundle for storage, as shown in FIG. 4.

Figure 5:
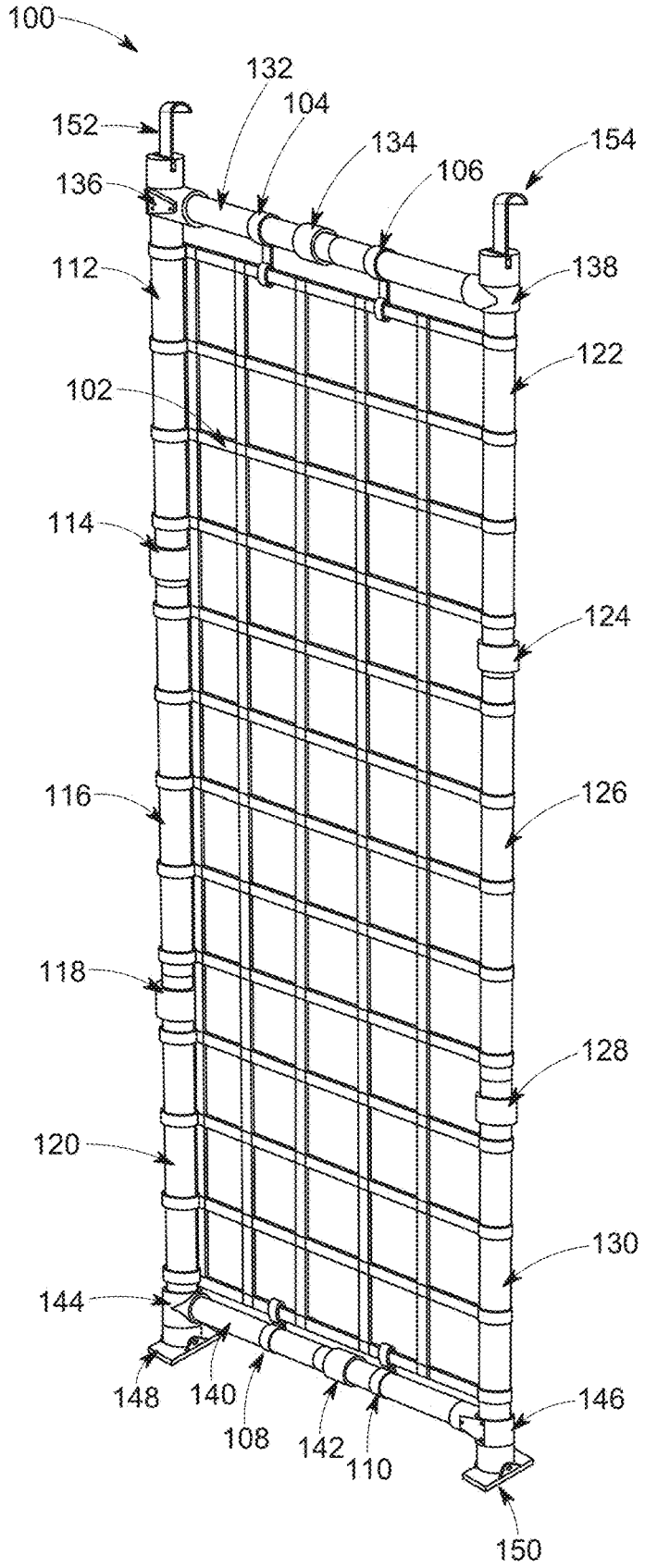
FIG. 5 shows a prospective view of another exemplary portable climbing net in an expanded configuration.

FIG. 5 shows a prospective view of another exemplary portable climbing net, portable climbing net 100 in an expanded configuration for use. Portable climbing net 100 may be like portable climbing net 1, as shown in FIGS. 1-4, and may contain many of the same components and features or similar components and features. As shown in FIG. 5, portable climbing net 100 may be comprised of net 102, which may be like a cargo or climbing net, and components of a rigid, collapsible frame. Net 102 may be made of a strong yet flexible material commonly used in climbing and/or cargo nets and cargo straps such as nylon, polyester, Dyneema, Kevlar, plastic, rope, cables, and/or other suitable materials. Net 102 may contain straps 104 and 106, which may comprise the top straps used to connect net 102 along its top row to the rigid frame; and straps 108 and 110, which may comprise the bottom straps used to connect net 102 along its bottom row to the rigid frame, as shown in FIG. 5. As further shown in FIG. 5, the rigid frame of portable climbing net 100 may have a side rail or handrail on one side (i.e., the left side) which is comprised of pole 112, connector 114, pole 116, connector 118, and pole 120; and another side rail or handrail on an opposite side (i.e., the right side) comprised of pole 122, connector 124, pole 126, connector 128, and pole 130. Pole 132 may comprise a top rail of portable climbing net 100, which may be a telescoping rail (i.e., a rail capable of variable lengths) whose length may be adjusted and secured by collar 134 and may be fastened by hinge 136 on pole 112 and to or by connector 138 on pole 122, as shown in FIG. 5. Pole 140 may comprise a bottom rail of portable climbing net 100, which may be a telescoping rail (i.e., a rail capable of variable lengths) whose length may be adjusted and secured by collar 142 and may be fastened to or by connector 144 on pole 120 and by hinge 146 on pole 130, as shown in FIG. 5. Poles 112, 116, 120, 122, 126, 130, 132, and 140 may be made of aluminum, steel, other metal, plastic, fiberglass, carbon fiber, other composite material, wood, or other material, or combination of materials. Poles 112, 116, 120, 122, 126, 130, 132, and 140 may be solid, hollow, or have a combination of solid and hollow portions; and may be round, square, rectangular, triangular, or may be some other shape or combination of shapes. Poles 112, 116, 120, 122, 126, 130, 132, and 140 may each have threads, holes, notches, protrusions, and/or other features located internally or externally toward one or both ends that may fit into, onto, or otherwise attach to corresponding threads, holes, notches, protrusions and/or other features located internally or externally toward one or both ends on an adjacent pole and/or connector on an adjacent pole that may allow quick attachment to and quick detachment from that pole and/or connector on that pole. Some or all of the pole, pipe, or tube components that comprise the rigid frame of portable climbing net 100 may be connected through and/or to some or all loops, if present, at the ends of columns and rows of net 102 or at or along other parts of net 102 by use of fasteners through grommets on net 102 (e.g., fastened to the side rails of portable climbing net 100), zip ties, ties, clamps, clips, carabiners, chain links, straps, cables, or by other methods of attaching the flexible net portion to the rigid frame, and/or they may simply slip through loops at the ends of each column and row of net 102 without being fixed (e.g., the side, top and/or bottom rails may pass through closed loops in the net). Pole 132 may also be secured to net 102 by use of straps 104 and 106, which may comprise top straps connectable to or connected to net 102; and pole 140 may also be secured to net 102 by use of straps 108 and 110, which may comprise bottom straps connectable to or connected to net 102. Whether some or all of the rigid frame components of portable climbing net 100 are permanently or semi-permanently fastened, connected, or otherwise secured to net 102; not fastened, connected, or secured at all and simply slipped through the loops in net 102, wherever present; or some portions are fastened, connected, or otherwise secured while other portions are not fastened, connected, or otherwise secured, when all portions of the rigid frame of portable climbing net 100 are connected, unfolded, expanded, or otherwise positioned for use, net 102 may be stretched, expanded, or otherwise positioned for use as a climbing surface and portable climbing net 100 will be configured for use as shown in FIG. 5.

Figure 6:
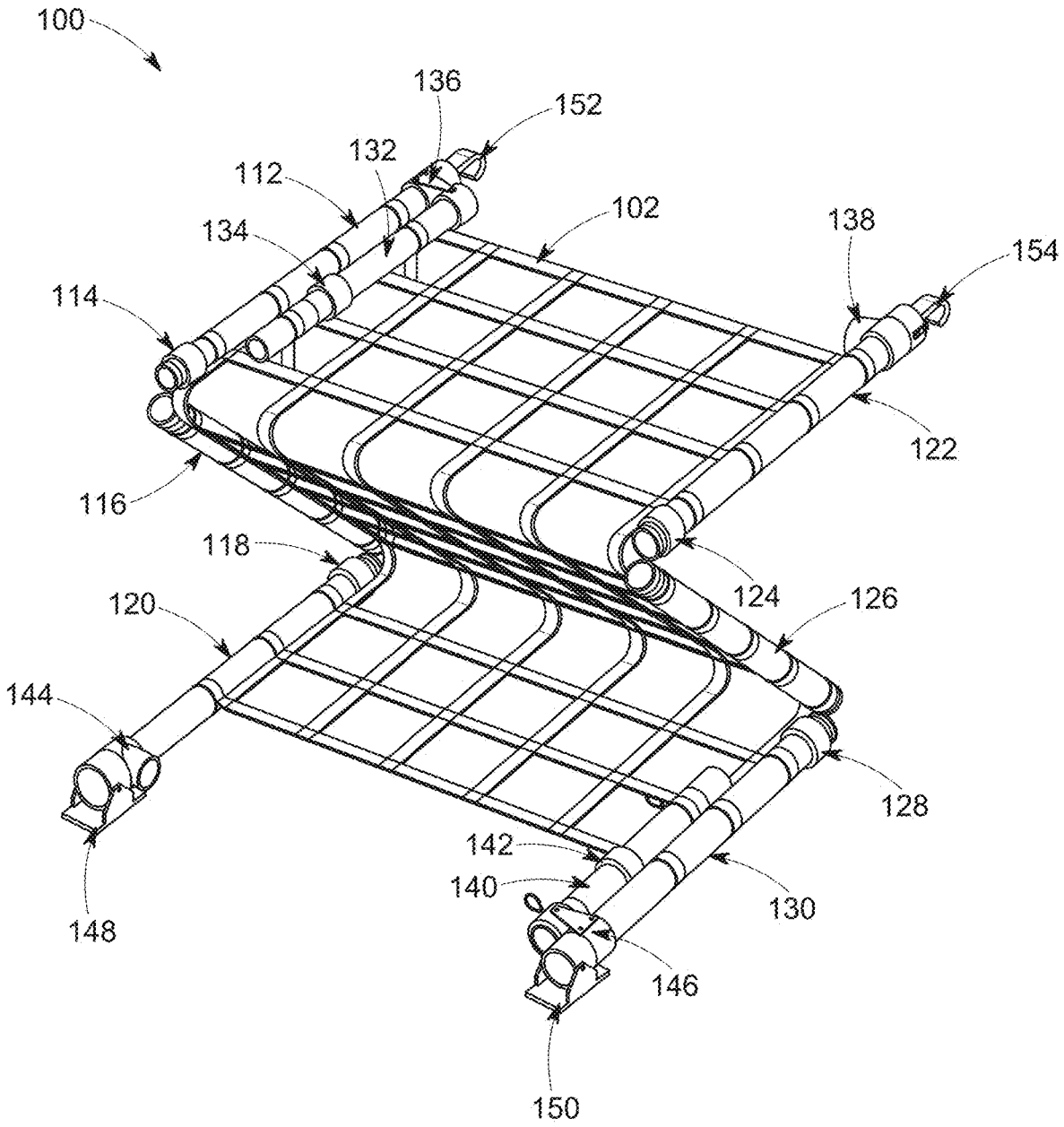
FIG. 6 shows a prospective view of another exemplary portable climbing net in transition from an expanded configuration to a collapsed configuration.
Figure 7:
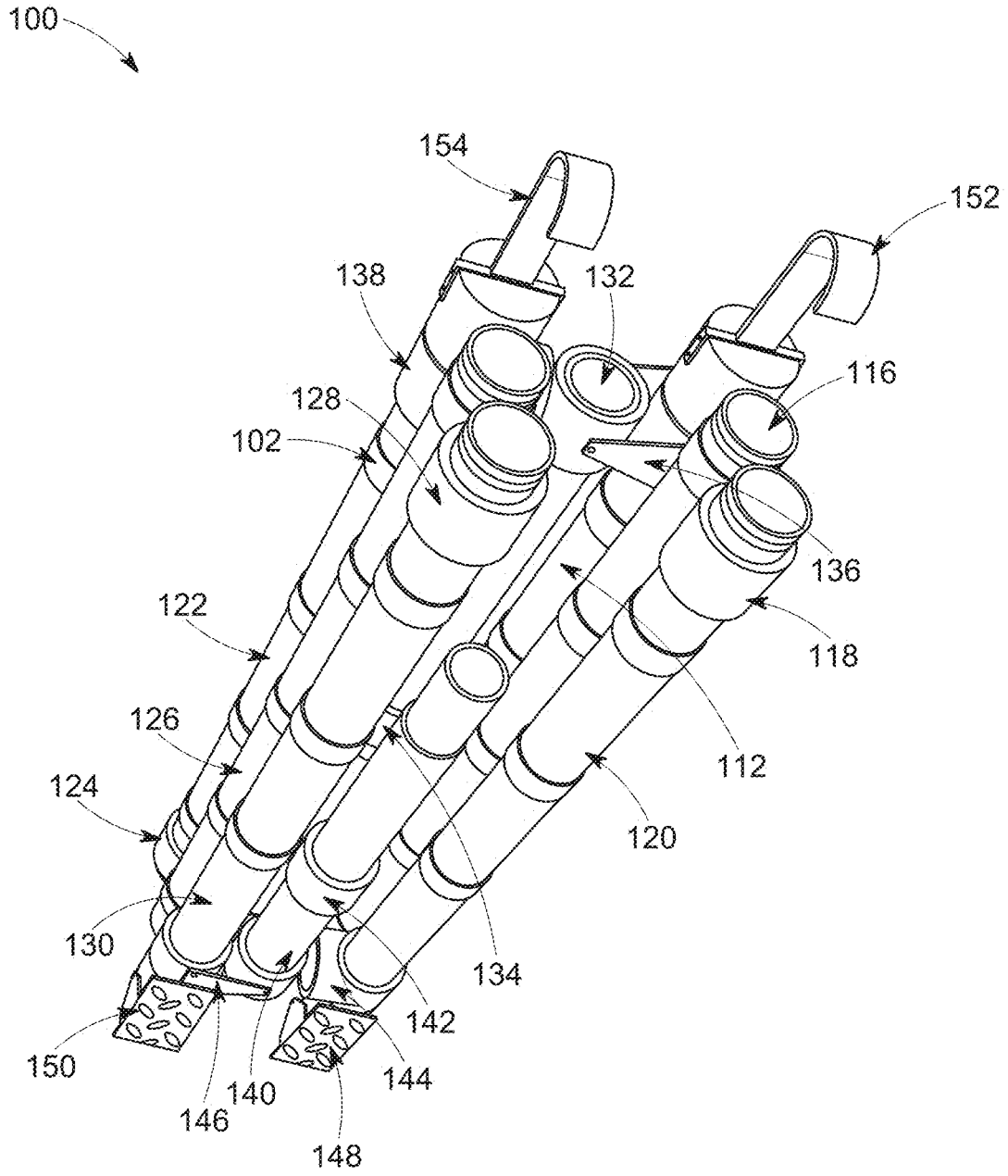
FIG. 7 shows a prospective view of another exemplary portable climbing net in a collapsed configuration.

As shown in FIG. 5, hinge 136 may be a hinge that connects pole 112 to pole 132 in a manner that may allow pole 112 to be connected perpendicularly with pole 132 for unfolding and use of portable climbing net 100 or may allow pole 132 to be folded against pole 112, as shown in FIGS. 6 and 7, to facilitate collapsing of portable climbing net 100 for storage. Hinge 136 may be permanently or semi-permanently attached to both poles 112 and 132 (e.g., by screws, pins, threaded collars, adhesive, welding, may be screwed directly onto or into the poles by use of internal or external threads that correspond to threads on the poles, or another fastening mechanism) and may be similar to commonly available pole hinges used to connect one pole, pipe, or tube to another pole, pipe, or tube. When opened or unfolded, hinge 136 may allow pole 132 to be positioned perpendicularly to pole 112 such that the other end of pole 132 may be connected to connector 138, as shown in FIG. 5, to facilitate positioning of portable climbing net 100 for use. When closed or folded, hinge 136 may allow pole 132 to be folded against pole 112, as shown in FIGS. 6 and 7, to facilitate collapsing of portable climbing net 100 for storage. Similarly and as also shown in FIG. 5, hinge 146 may be a hinge that connects pole 130 to pole 140 in a manner that may allow pole 140 to be connected perpendicularly with pole 130 for unfolding and use of portable climbing net 100 or may allow pole 140 to be folded against pole 130, as shown in FIGS. 6 and 7, to facilitate collapsing of portable climbing net 100 for storage. Hinge 146 may be permanently or semi-permanently attached to both poles 130 and 140 (e.g., by screws, pins, threaded collars, adhesive, welding, may be screwed directly onto or into the poles by use of internal or external threads that correspond to threads on the poles, or another fastening mechanism) and may be similar to commonly available pole hinges used to connect one pole, pipe, or tube to another pole, pipe, or tube. When opened or unfolded, hinge 146 may allow pole 140 to be positioned perpendicularly to pole 130 such that the other end of pole 140 may be connected to connector 144, as shown in FIG. 5, to facilitate positioning of portable climbing net 100 for use. When closed or folded, hinge 146 may allow pole 140 to be folded against pole 130, as shown in FIGS. 6 and 7, to facilitate collapsing of portable climbing net 100 for storage.

As shown in FIG. 5, connectors 138 and 144 may contain some or all portions of brackets, pins, screws, holes, clamps, threaded collars, internal or external threads, and/or other components or combination of components that may be used to quickly connect one pole, pipe, or tube perpendicularly to another pole, pipe, or tube for use or to quickly disconnect one pole, pipe, or tube from another pole, pipe, or tube for storage. Connector 138 may have some or all components located on pole 122, which may comprise the upper portion of one of the side rails of portable climbing net 100; connector 138 may have some or all components located on pole 132, which may comprise the top rail of portable climbing net 100; or connector 138 may have portions located on both poles 122 and 132. Some or all portions of connector 138 may be fastened to poles 122 and/or 132 by pins, screws, threaded collars, adhesive, welding, and/or another fastening mechanism; connector 138 may be screwed directly onto or into poles 122 and/or 132 (i.e., connector 138 may have internal or external threads that may be capable of screwing onto or into corresponding threads on poles 122 and/or 132); or some or all portions of connector 138 may be integrated portions of poles 122 and/or 132 (e.g., they may be protrusions from or sections of the poles themselves, or may be the internal or external threads on each pole capable of being screwed into or out of corresponding threads on the pole(s) to which they connect to). Connector 138 may temporarily connect poles 122 to pole 132 (i.e., when portable climbing net 100 is expanded for use) and may be used to disconnect pole 122 from pole 132 (i.e., when portable climbing net 100 is collapsed for storage) by use of pins, screws, clamps, latches, threaded collars, by the action of screwing onto or into poles and unscrewing from poles, and/or another mechanism or method that may be used to make quick connections and disconnections. Connector 144 may have some or all components located on pole 120, which may comprise the lower portion of one of the side rails of portable climbing net 100; connector 144 may have some or all components located on pole 140, which may comprise the bottom rail of portable climbing net 100; or connector 144 may have portions located on both poles 120 and 140. Some or all portions of connector 144 may be fastened to pole 120 and/or 140 by pins, screws, threaded collars, adhesive, welding, and/or another fastening mechanism; connector 144 may be screwed directly onto or into poles 120 and/or 140 (i.e., connector 144 may have internal or external threads that may be capable of screwing onto or into corresponding threads on poles 120 and/or 140); or some or all portions of connector 144 may be integrated portions of poles 120 and/or 140 (e.g., they may be protrusions from or sections of the poles themselves, or may be the internal or external threads on each pole capable of being screwed into or out of corresponding threads on the pole(s) to which they connect to). Connector 144 may temporarily connect pole 120 to pole 140 (i.e., when portable climbing net 100 is expanded for use) and may be used to disconnect pole 120 from pole 140 (i.e., when portable climbing net 100 is collapsed for storage) by use of pins, screws, clamps, latches, threaded collars, by the action of screwing onto or into poles and unscrewing from poles, and/or another mechanism or method that may be used to make quick connections and disconnections.

Alternatively, portable climbing net 100 may be configured in a such a way that hinge 136 may be on the right side of portable climbing net 100 such that it hingedly connects pole 132 to pole 122 and connector 138 may be on the left side of portable climbing net 100 such that it may temporarily connect pole 132 to pole 112 to position portable climbing net 100 for use or disconnect pole 132 from pole 112 to position portable climbing net 100 for storage; and/or portable climbing net 100 may be configured in a such a way that hinge 146 may be on the left side of portable climbing net 100 such that it hingedly connects pole 140 to pole 120 and connector 144 may be on the right side of portable climbing net 100 such that it may temporarily connect pole 140 to pole 130 to position portable climbing net 100 for use or disconnect pole 140 from pole 130 to position portable climbing net 100 for storage.

In another alternative configuration of portable climbing net 100, hinges 136 and 146 may not be hinges at all and may be exactly like or similar to the connectors described above (i.e., the connector on the opposite side of each hinge on either the top or bottom rails). For example, hinges 136 and 146 may instead be configured as connectors 136 and 146 and may be like or similar to connectors 138 and 144, respectively. If hinges 136 and 146 were instead configured as connectors 136 and 146, and were like connectors 138 and 144, respectively, then connectors 136 and 138 may be capable of completely disconnecting pole 132 from poles 112 and 122, respectively, and connectors 144 and 146 may be capable of completely disconnecting pole 140 from poles 120 and 130, respectively, to facilitate storage of portable climbing net 100. To configure portable climbing net 100 for use, pole 132 may be connected to poles 112 and 122 by use of connector 136 (i.e., if hinge 136 was configured as connector 136) and connector 138, respectively, and pole 140 may be connected to poles 120 and 130 by use of connector 144 and connector 146 (i.e., if hinge 146 was configured as connector 146).

As shown in FIG. 5, to position portable climbing net 100 for use, connector 114 may connect pole 112 to pole 116 such that pole 112 may be connected in line with pole 116; connector 118 may connect pole 116 to pole 120 such that pole 116 may be connected in line with pole 120; connector 124 may connect pole 122 to pole 126 such that pole 122 may be connected in line with pole 126; and connector 128 may connect pole 126 to pole 130 such that pole 126 may be connected in line with pole 130. As shown in FIGS. 6 and 7, to position portable climbing net 100 for storage, connector 114 may be used to disconnect pole 112 from pole 116; connector 118 may be used to disconnect pole 116 from pole 120; connector 124 may be used to disconnect pole 122 from pole 126; and connector 128 may be used to disconnect pole 126 from pole 130. Connectors 114, 118, 124, and 128 may be or contain threaded collars that are screwed or threaded across the joint between two poles, pipes, or tubes, such that when the collars are tightened, the two poles, pipes, or tubes they connect may be temporarily joined, forming a longer, more continuous pole, pipe, or tube section. For example, and as shown in FIG. 5, connector 114 may be threaded or screwed onto threads at the adjacent ends of both poles 112 and 116, spanning the joint between poles 112 and 116, causing poles 112 and 116 to be temporarily, yet securely, connected to form a longer, more continuous pole section; connector 118 may be threaded or screwed onto threads at the adjacent ends of both poles 116 and 120, spanning the joint between poles 116 and 120, causing poles 116 and 120 to be temporarily, yet securely, connected to form a longer, more continuous pole section; connector 124 may be threaded or screwed onto threads at the adjacent ends of both poles 122 and 126, spanning the joint between poles 122 and 126, causing poles 122 and 126 to be temporarily, yet securely, connected to form a longer, more continuous pole section; and connector 128 may be threaded or screwed onto threads at the adjacent ends of both poles 126 and 130, spanning the joint between poles 126 and 130, causing poles 126 and 130 to be temporarily, yet securely, connected to form a longer, more continuous pole section. Once each connector on each side rail or handrail (i.e., the left side rail or handrail and the right side rail or handrail) of portable climbing net 100 is threaded across two adjacent poles, each side rail or handrail is fully elongated to facilitate positioning of portable climbing net 100 for use. If connectors 114, 118, 124, and 128 are threaded across two poles, pipes, or tubes, as described above, connectors 114, 118, 124, and 128, respectively, may each be unscrewed or unthreaded from one pole, pipe, or tube such that each connector is then only attached to one of two adjacent poles, pipes, or tubes causing the two adjacent poles, pipes, or tubes to become disconnected. For example, and as shown in FIGS. 6 and 7, connector 114 may be unthreaded or unscrewed from pole 116 such that it may only be connected to pole 112, causing poles 112 and 116 to become disconnected; connector 118 may be unthreaded or unscrewed from pole 116 such that it may only be connected to pole 120, causing poles 116 and 120 to become disconnected; connector 124 may be unthreaded or unscrewed from pole 126 such that it may only be connected to pole 122; causing poles 122 and 126 to become disconnected; and connector 128 may be unthreaded or unscrewed from pole 126 such that it may only be connected to pole 130, causing poles 126 and 130 to become disconnected. Once each connector on each side rail or handrail (i.e., the left side rail or handrail and the right side rail or handrail) is disconnected from one pole such that it is only attached to one of two adjacent poles, each side rail or handrail is separated into smaller sections to facilitate positioning of portable climbing net 100 for storage.

If some or all loops of net 102 (i.e., the loops at the ends of each row of net 102), if present, or if other portions of net 102 are permanently or semi-permanently connected to the rigid frame components that make up each side rail or hand rail (i.e., poles 112, 116, and 120, on the left side rail or handrail and poles 122, 126, and 130 on the right side rail or handrail) of portable climbing net 100, as described previously, and once all rigid frame components are disconnected and/or folded, as described above, net 102 may still keep each of poles 112, 116, 120, 122, 126, and 130 relatively close to their adjacent poles on each side of portable climbing net 100, as shown in FIG. 6, as if they were all hinged to their adjacent poles. This configuration may aide in storage of portable climbing net 100 by allowing the rigid frame components that make up each side rail or handrail (i.e., poles 112, 116, and 120 on the left side rail or handrail and poles 122, 126, and 130 on the right side rail or handrail)

to be collapsed and/or folded along with net 102; and may aide in expansion of portable climbing net 100 for use by making connections of the rigid frame components easier since adjacent poles may already be close to each other when all components are laid out or spread out for expansion, as if they were hinged to each other. If the rigid frame components that make up each side rail or hand rail (i.e., poles 112, 116, and 120 on the left side rail or handrail and poles 122, 126, and 130 on the right side rail or handrail) of portable climbing net 100 are not attached to net 102 and are simply passed through the loops at the end of each row of net 102 to expand portable climbing net 100 for use, then poles 112, 116, 120, 122, 126, and 130 may simply be removed from net 102 for storage. This configuration may aide in storage of portable climbing net 100 since the rigid frame components that make up the side rails or handrails (i.e., poles 112, 116, and 120 on the left side rail or handrail and poles 122, 126, and 130 on the right side rail or handrail) may be stored separately from each other and/or the net and therefore each may separately require less storage space; and net 102 may be folded or compressed into a much smaller bundle without any rigid components attached to it or it may be stored in areas where rigid components may otherwise cause damage to other items (e.g., if the rigid components are placed on top of sensitive items or can scratch sensitive items if attached to net 102 and it is stored on or near these items) or be damaged by other items (e.g., if heavy items are placed on top of net 102 while it has rigid components attached to it that can bend, scratch, or otherwise damage the rigid components). However, this configuration may add additional steps to the expansion of portable climbing net 100 for use since it may require the rigid frame components that make up each side rail or hand rail (i.e., poles 112, 116, and 120 on the left side rail or handrail and poles 122, 126, and 130 on the right side rail or handrail) to first be passed through the corresponding loops of net 102 and positioned next to their adjacent poles for reattachment or may require reattachment of poles that make up each side rail or handrail (i.e., pole 112 to pole 116 to pole 120 on the left side rail or handrail and pole 122 to pole 126 to pole 130 on the right side rail or handrail) first and then be passed through the loops at the end of each row of net 102 to facilitate expansion of portable climbing net 100.

Connectors 114, 118, 124, and 128 may also contain other components or features that may aide in connecting and/or disconnecting two poles, pipes, or tubes to or from, respectively, each other in addition to having or being threaded collars.

For example, connectors 114, 118, 124, and 128 may also contain internal pole, pipe, or tube hinges, which are commonly available, that may be attached to the interior sides of two adjacent poles, pipes, or tubes, such that when the hinges are unfolded to position the two poles, pipes, or tubes in line with each other, all or most of the hinge is concealed inside the joint of the longer pole, pipe, or tube section.

Since the hinge or most of the hinge may be concealed or may lie within the inside diameter of two poles, pipes, or tubes, a threaded collar may still be threaded or screwed across two poles, pipes, or tubes; and may still be unthreaded or unscrewed from one or both poles, pipes, or tubes along the exterior diameter or surface of the poles, pipes, or tubes without interference from the hinge.

In this configuration, a hinge, if a connector is configured to be a threaded collar that may also contain an internal hinge, the connector may keep two adjacent poles, pipes, or tubes, permanently or semi-permanently connected in both an in-line position (e.g., for use) and/or folded position (e.g., for storage), as previously described herein for other hinges.

For example, if connector 114 also contains an internal hinge in addition to a collar, connector 114 may be threaded or screwed onto threads at the adjacent ends of both poles 112 and 116, spanning the joint between poles 112 and 116, which may include an internal hinge, causing poles 112 and 116 to be temporarily, yet securely, connected to form a longer, more continuous pole section; connector 118 may be threaded or screwed onto threads at the adjacent ends of both poles 116 and 120, spanning the joint between poles 116 and 120, which may include an internal hinge, causing poles 116 and 120 to be temporarily, yet securely, connected to form a longer, more continuous pole section.

Connector 124 may be threaded or screwed onto threads at the adjacent ends of both poles 122 and 126, spanning the joint between poles 122 and 126, which may include an internal hinge, causing poles 122 and 126 to be temporarily, yet securely, connected to form a longer, more continuous pole section; and connector 128 may be threaded or screwed onto threads at the adjacent ends of both poles 126 and 130, spanning the joint between poles 126 and 130, which may include an internal hinge, causing poles 126 and 130 to be temporarily, yet securely, connected to form a longer, more continuous pole section.

Once the collar portion of each connector on each side rail or handrail (i.e., the left side rail or handrail and the right side rail or handrail) of portable climbing net 100 is threaded across two adjacent poles and if the connector also contains an internal hinge, each side rail or handrail may be fully elongated to facilitate positioning of portable climbing net 100 for use.

If connectors 114, 118, 124, and 128 each also has an internal hinge as well as a collar that is threaded across two poles, pipes, or tubes, as described above, the collars of connectors 114, 118, 124, and 128, respectively, may each be unscrewed or unthreaded from one pole, pipe, or tube such that each collar portion is then only attached to one of two adjacent poles, pipes, or tubes while the internal hinge remains attached to both adjacent poles, pipes, or tubes causing the two connected poles, pipes, or tubes to become partially disconnected such that they may be folded against each other.

For example, the collar portion of connector 114 may be unthreaded or unscrewed from pole 116 such that it may only be connected to pole 112, while the internal hinge portion may remain connected to both poles 112 and 116, causing poles 112 and 116 to become partially disconnected so that poles 112 and 116 may be folded against each other; the collar portion of connector 118 may be unthreaded or unscrewed from pole 116 such that it may only be connected to pole 120, while the internal hinge portion may remain connected to both poles 116 and 120, causing poles 116 and 120 to become partially disconnected so that poles 116 and 120 may be folded against each other.

The collar portion of connector 124 may be unthreaded or unscrewed from pole 126 such that it may only be connected to pole 122, while the internal hinge portion may remain connected to both poles 122 and 126, causing poles 122 and 126 to become partially disconnected so that poles 122 and 126 may be folded against each other; and the collar portion of connector 128 may be unthreaded or unscrewed from pole 126 such that it may only be connected to pole 130, while the internal hinge portion may remain connected to both poles 126 and 130, causing poles 126 and 130 to become partially disconnected so that poles 126 and 130 may be folded against each other.

Once the collar portion of each connector on each side rail or handrail (i.e., the left side rail or handrail and the right side rail or handrail) is disconnected from one pole such that it is only attached to one of two adjacent poles and if the connector also contains an internal hinge that remains attached to both adjacent poles, each side rail or handrail is foldable into sections to facilitate positioning of portable climbing net 100 for storage.

Alternatively, connectors 114, 118, 124, and 128 may not be or contain collars and/or internal hinges but, may instead be or contain external hinges, similar to other pole, pipe, or tube hinges previously described herein as hinges that may connect two poles, pipes, or tubes in line with each other to form a longer, more continuous pole section; or may disconnect two poles, pipes, or tubes from each other allowing them to be folded against each other.

In addition to collars, internal hinges, and external hinges, connectors 114, 118, 124, and 128 may alternatively be or contain other types of connecting mechanisms that may contain screws, pins, brackets, holes, or other mechanisms capable of quickly and temporarily connecting two poles, pipes or tubes in line with each other for use; or quickly disconnecting fully or partially two poles, pipes, or tubes from each other for storage.

Collars 134 and 142 may be like collars mentioned previously and like typical collars found on extendable poles, pipes and tubes that, when loosened, may allow an inner pole, pipe, or tube to extend out of or retract into an outer pole, pipe, or tube (i.e., one pole, pipe or tube has a smaller diameter relative to another pole, pipe, or tube, such that one pole, pipe, or tube may "nest" inside another pole pipe or tube for storage; be retracted (e.g., pushed in) to shorten the combined length of the two poles, pipes, or tubes for storage or use; or be extended (e.g., telescoped or lengthened) to extend the combined length of the two poles, pipe, or tubes) and, when tightened, may allow the inner pole, pipe, or tube to be tightly secured in an extended (or lengthened) position or a retracted (or shortened) position, allowing poles 132 and 140, respectively, to be adjusted to various lengths for various purposes.

By adjusting the length of poles 132 and 140, by use of collars 134 and 142, respectively, the width of climbing net 100, when it is configured for use, may be accordingly adjusted and net 102 may either be stretched to be tauter for easier climbing, as shown in FIG. 5, or be left loose to create more of a pocket for safer climbing, as described in more detail later and shown in FIG. 8.

Adjusting the length of poles 132 and 140 by use of collars 134 and 142, respectively, to be shorter or to be at their shortest length may aide in reducing the stored length of the bundle of poles when portable climbing net 100 is configured for storage, as shown in FIGS. 6 and 7.

As shown in FIG. 5, at the bottom of each side rail (i.e., the left- and right-side rails), portable climbing net 100 may contain feet that are similar to ladder feet and may be capable of pivoting or rotating to allow portable climbing net 100 to lean at various angles for use or to allow folding for storage, as shown in FIGS. 6 and 7. As shown in FIG. 5, foot 148 may be fastened to the bottom of pole 120, and foot 150 may be fastened to the bottom of pole 130.

Feet 148 and 150 may be fastened to poles 120 and 130, respectively, by pins, screws, threaded collars, adhesive, welding, and/or another fastening method, or may be screwed directly onto or into their respective poles. Feet 148 and 150 may have a relatively flat base that may have texture, groves, or tread on the bottom to allow for a non-slip, firm, or secure placement on the ground below. Feet 148 and 150 may be comprised of metal, plastic, rubber, fiberglass, carbon fiber, other composite materials, other materials, or some combination of materials. As previously mentioned, pivoting or rotating of feet 148 and 150 relative to poles 120 and 130, respectively, may allow portable climbing net 100 to lean at various angles to achieve various climbing heights or for more or less of a slope, when in use, as shown in FIG. 5, or may also allow feet 148 and 150 to be folded flat against poles 120 and 130, respectively, for storage of portable climbing net 100, as shown in FIGS. 6 and 7. Feet 148 and 150 may also be height adjustable by use of a pin, spring-loaded button, or screw and various positioning holes on the shaft of feet 148 and 150, or by having feet whose height may be adjusted by screwing them into or out of the bottoms of the lower side poles of portable climbing net 100, as commonly found on many ladder or table feet and/or legs.

As shown in FIG. 5, the tops of the side rails (i.e., the left- and right-side rails) of portable climbing net 100, may contain hooks 152 and 154, respectively. Hooks 152 and 154 may be hooks to hook portable climbing 100 onto an edge of a raised surface or onto a ladder bracket on a raised surface, such as a rooftop tent or rooftop camper, a roof rack on a vehicle, or some other elevated surface. Hook 152 may be fastened to pole 112 and hook 154 may be fastened to pole 122 by pins, screws, threaded collars, adhesive, welding, or another fastening method, or each may be screwed directly onto or into their respective poles. Alternatively hooks 152 and 154 may not be curved and may instead be components capable of simply resting against an elevated surface, similar to the tops of handrails on many common ladders. Hooks 152 and 154 may be comprised of metal, plastic, rubber, fiberglass, carbon fiber, other composite materials, other materials, or some combination of materials.

With portable climbing net 100 in expanded configuration for use, as shown in FIG. 5, with the rigid frame components unfolded and connected thereby supporting, expanding, stretching, or otherwise positioning net 102 for use as a climbing surface, a person may use it to safely and securely climb up to access an elevated area such as a rooftop tent or rooftop camper, vehicle roof rack, or other elevated surface; or a person may use it to safely and securely climb down from such an area. To store portable climbing net 100, the rigid frame components may be disconnected, loosened, shortened, and/or folded allowing net 102 to collapse, as shown in transition in FIG. 6 and shown fully collapsed or compressed in FIG. 7.

FIG. 6 shows portable climbing net 100 in a first transition from an expanded position for use to a stored position for storage. First, straps 104 and 106 connecting net 102 to pole 132 may be unstrapped or otherwise disconnected from net 102 (or alternatively, from pole 132); and straps 108 and 110 connecting net 102 to pole 140 may be unstrapped or otherwise disconnected from net 102 (or alternatively, from pole 140) as shown in FIG. 6. Connectors 138 and 144 may then be used to disconnect poles 132 and 140, respectively, from poles 122 and 120, respectively, as shown in FIG. 6. Then collars 134 and 142 may be loosened such that the smaller diameter pole sections of poles 132 and 140, respectively, may be capable of sliding into the larger diameter pole sections of poles 132 and 140, respectively, until the total length of poles 132 and 140, respectively, is at the desired or shortest length for storage, if necessary, as shown in FIG. 6. Then, hinges 136 and 146 may be used to fold poles 132 and 140, respectively, against poles 112 and 130, respectively, as shown in FIG. 6. Once the top and bottom rails (i.e., rails 132 and 140) are disconnected, shortened (if necessary), and folded, then each side rail or handrail (i.e., the left side rail or handrail and the right side rail or handrail) may be separated, disconnected, loosened, and/or folded for storage, as described previously.

As shown in FIG. 6, connector 114 may be unthreaded or unscrewed from pole 116 such that it is only on pole 112, separating pole 112 from pole 116 or allowing pole 112 to be partially disconnected from and folded against pole 116; connector 118 may be unthreaded or unscrewed from pole 116 such that it is only on pole 120, separating pole 116 from pole 120 or allowing pole 116 to be partially disconnected from and folded against pole 120; connector 124 may be unthreaded or unscrewed from pole 126 such that it is only on pole 122, separating pole 122 from pole 126 or allowing pole 122 to be partially disconnected from and folded against pole 126; and connector 128 may be unthreaded or unscrewed from pole 126 such that it is only on pole 130, separating pole 126 from pole 130 or allowing pole 126 to be partially disconnected from and folded against pole 130. With all connectors unthreaded, unscrewed, loosened, or configured to allow adjacent pole sections to be fully or partially disconnected and separated or folded, each side rail or handrail of portable climbing net 100 may be separated or folded into smaller pole sections for storage. Once each side rail or handrail (i.e., the left side rail or handrail and the right side rail or handrail) and top and bottom rails are disconnected, separated, folded, shortened, and/or removed, portable climbing net 100 may be collapsed, pushed together, rolled up, or otherwise compressed into a smaller bundle for storage, as shown in FIG. 7.

As previously discussed, collars 134 and 142 may be used to adjust the length of poles 132 and 140, respectively, of climbing net 100. As previously discussed and shown in FIG. 5, when expanding portable climbing net 100 for use, collars 134 and 142 may be used to extend poles 132 and 140, respectively, to be at or near their maximum length which may cause net 102 to be at its maximum width which may make it taut and easier to climb (i.e., net 102 may not flex, move, or sway as much when at it is stretched to or near its maximum length and width, as shown in FIG. 5, which may making it more stable for climbing).

As also previously discussed and shown in FIGS. 6 and 7, collars 134 and 142 may be used to shorten poles 132 and 140, respectively, for storage. When expanding portable climbing net 100 for use, collars 134 and 142 may also be used to adjust the length of poles 132 and 140, respectively, to be shorter than their maximum length and shorter than the maximum width of net 102, which may cause net 102 to form a pocket, as shown in FIG. 8. This alternative configuration of portable climbing net 100 for use may allow the side rails or handrails (i.e., poles 112, 116, and 120 which may form the left side rail or handrail, and poles 122, 126, and 130 which may form the right side rail or handrail) to be relatively higher than lowest part of net 102 (e.g., the part that a person may stand on). This configuration of portable climbing net 100 may be similar to the configuration of portable climbing net 100 previously discussed and shown in FIG. 5.

In the configuration shown in FIG. 8, the side rails or handrails (e.g., left side rail or handrail and right side rail or handrail) may be configured as follows: pole 112 may be connected in line with pole 116 by connector 114; pole 116 may be connected in line with pole 120 by connector 118; pole 122 may be connected in line with pole 126 by connector 124; and pole 126 may be connected in line with pole 130 by connector 128. If the poles that make up the side rails or handrails are not already passed through and/or fastened to net 102, they may now be passed through net 102, as shown in FIG. 8. As also shown in FIG. 8, hinge 136 may be used to extend pole 132 perpendicularly to connect with connector 138 and hinge 146 may be used to extend pole 140 perpendicularly to connect with connector 144. Collars 134 and 142 may be used to secure poles 132 and 140, respectively, at widths that are shorter than the maximum width of net 102, as shown in FIG. 8. Then poles 132 and 140 may be attached to connectors 138 and 144, respectively, as shown in FIG. 8. Net 102 may then also be connected to pole 132 by straps 104 and 106 and connected to pole 140 by straps 108 and 110, as shown in FIG. 8. Then feet 148 and 150 and hooks 152 and 154 may be configured for use as shown in FIG. 8.

Figure 8:
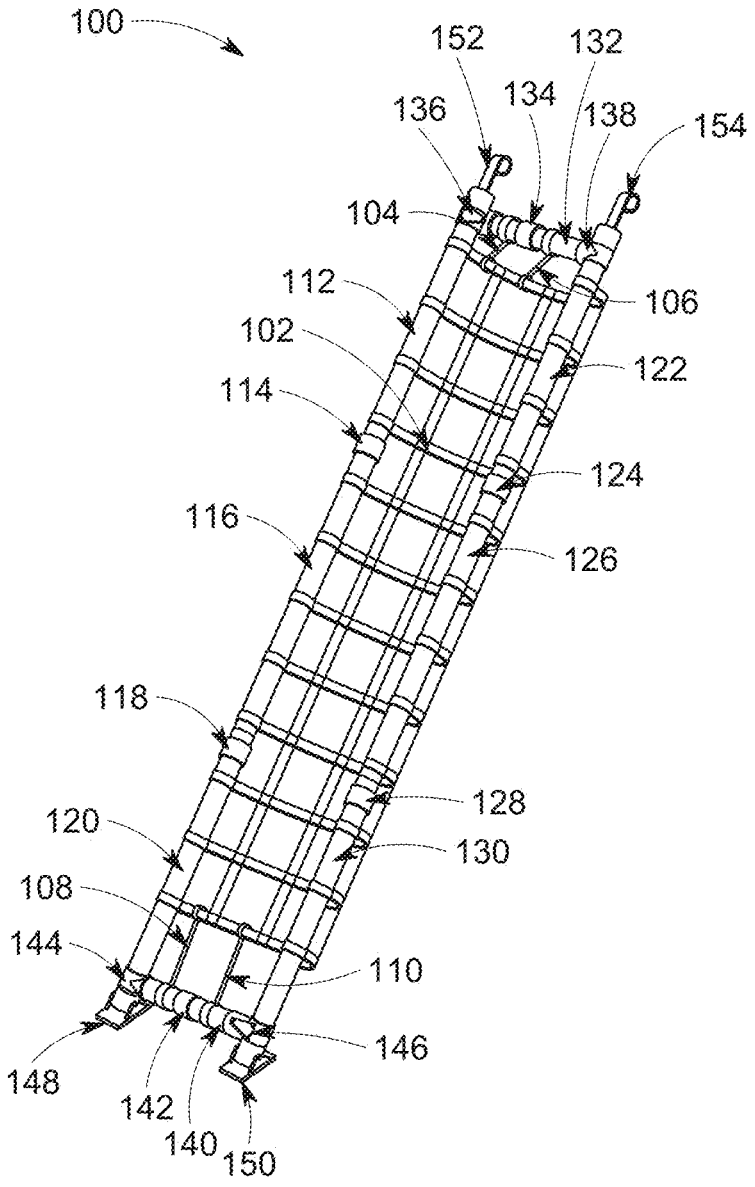
FIG. 8 shows the exemplary portable climbing net of FIG. 5 in narrower, expanded configuration.

The configuration for use of portable climbing net 100 shown in FIG. 8 may be safer for very young children to climb because the raised sides formed by this pocket may prevent a small child from falling over the sides of portable climbing net 100. Some people may also find this configuration easier to climb because with the raised side rails or handrails, a person may not have to lean over as much and may remain more upright when climbing. However, since net 102 may be looser than if it was stretched taut, more effort to stabilize oneself when climbing may be required since the net may flex, move, or sway more when it is stepped on. Whether a taut climbing surface, as shown in FIG. 5, or a pocketed climbing surface, as shown in FIG. 8, is easier and/or safer to climb may be a matter of personal choice and the ability to adjust the width of climbing net 100 by adjusting the length of poles 132 and 140 by use of collars 134 and 142, respectively, may give a person that choice.

The components of portable climbing net 1 and portable climbing net 100 discussed previously may be the same, different, or interchangeable across the two configurations of portable climbing nets and both climbing nets may have features that are the same, similar, or different across the two configurations of portable climbing nets. For example, the poles, hinges, connectors, collars, feet, hooks, net, straps, and other components may be the same, similar, or different across both configurations and may offer the same, similar, or different features.

Portable climbing nets 1 and 100 may also be configured to have more or fewer rigid frame sections that may be combined with longer or shorter nets which may allow the portable climbing nets to be taller and reach greater heights and/or shorter when stored. For example, more pole sections on the side rails or handrails of portable climbing nets 1 and 100 may increase the length of the portable climbing nets' side rails or handrail and, combined, with a longer net may allow the portable climbing nets to be taller. More and shorter pole sections on the side rails or handrails of portable climbing nets 1 and 100 may decrease the stored length of the portable climbing nets' side rails or handrails which may allow the portable climbing nets to be shorter when stored. Increased lengths of the top and bottom rails of portable climbing nets 1 and 100 combined with a wider net may allow the portable climbing nets to be wider when configured for use; and decreased lengths of the top and bottom rails of portable climbing nets 1 and 100 combined with a narrower net may allow the portable climbing nets to be narrower when configured for use.

Figure 9:
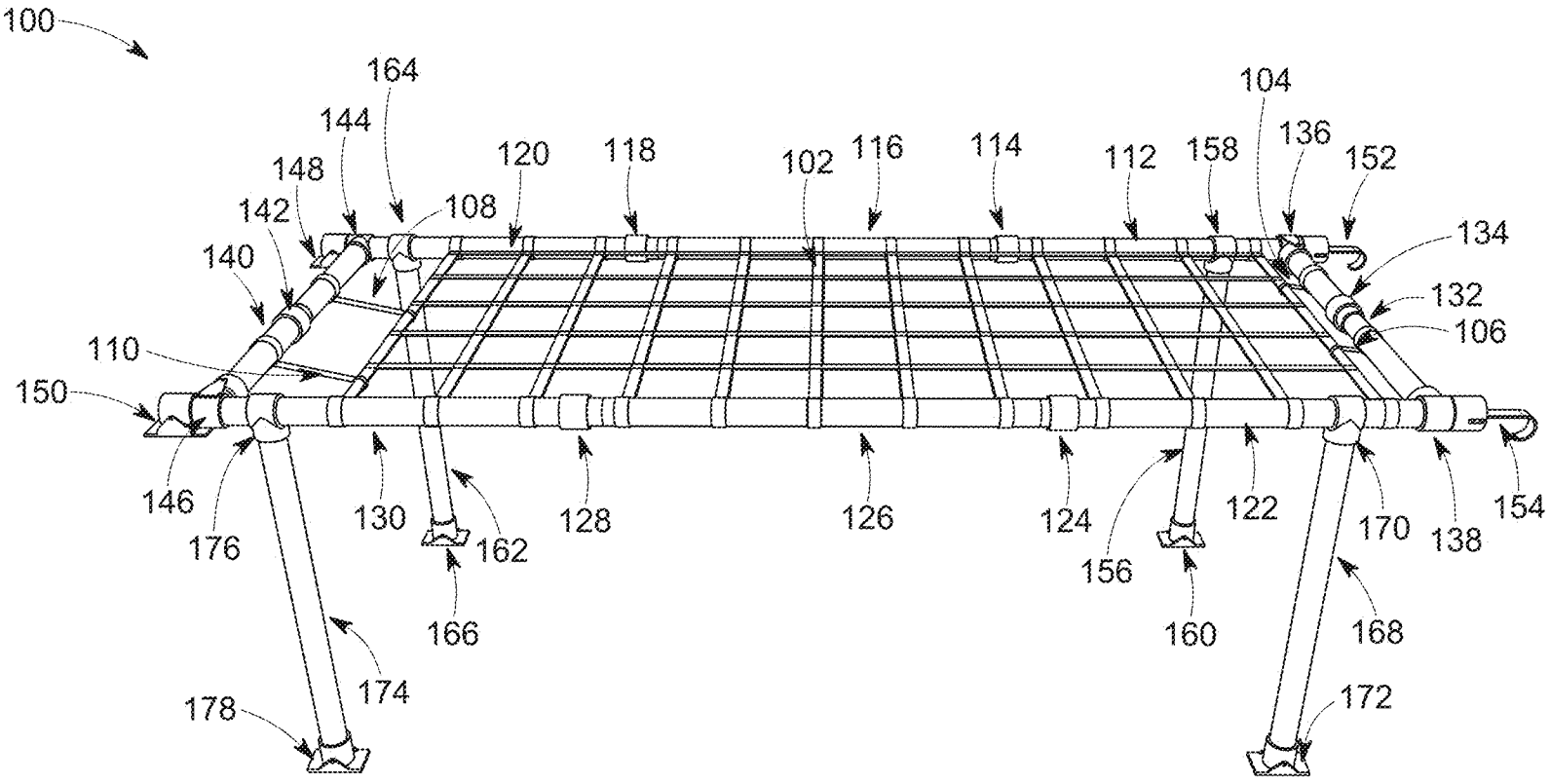
FIG. 9 shows the exemplary portable climbing net of FIG. 5 configured for use as a table or cot.

Alternative uses of portable climbing net 1 and portable climbing net 100 may be achieved with additional components and/or additional configurations. For example, if the portable climbing nets are positioned horizontally and combined with additional connectors, poles, and feet that may be added to the side rails or handrails of the portable climbing nets, they may be used as tables and/or cots, as shown in FIG. 9. FIG. 9 shows portable climbing net 100 configured for use as a table or cot for illustrative purposes however, similar components may be added to portable climbing net 1 and it may be similarly configured for use as a table and/or cot. Portable climbing net 100 may be expanded as discussed previously and shown in FIG. 5 however, it may be positioned horizontally and combined with additional poles that may serve as legs, additional connectors to connect those poles to the side rails and/or handrails and additional feet on the additional poles for secure, horizontal placement of portable climbing net 100 on a surface, as shown in FIG. 9.

As shown in FIG. 9, pole 156 with foot 160 may be connected to pole 112 by use of connector 158; pole 162 with foot 166 may be connected to pole 120 by use of connector 164; pole 168 with foot 174 may be connected to pole 122 by use of connector 170; and pole 174 with foot 178 may be connected to pole 130 by use of connector 176. Connectors 158, 164, 170, and 176 may be the same as or similar to other connectors described herein that may be used to quickly and perpendicularly connect one pole, pipe, or tube to another pole, pipe, or tube, for use or may be used to quickly disconnect one pole, pipe, or tube for storage. Poles 156, 162, 168, and 174 may the same as or similar to other poles described herein and may be of a fixed length or an adjustable length. Feet 160, 166, 172, and 178 may the same as or similar to other feet described herein and may be pivoting, rotating, fixed, and/or of adjustable height. Some or all portions of connector 158 may be on pole 112, pole 156, or both poles; some or all portions of connector 164 may be on pole 120, pole 162, or both poles; some or all portions of connector 170 may be on pole 122, pole 168, or both poles; and some or all portions of connector 176 may be on pole 130, pole 174, or both poles. For storage, poles 156, 162, 168, and 174 may be disconnected by or from their respective connectors, 158, 164, 170, and 176 and may be stored separately from the other components of portable climbing net 100 or together with the other components of portable climbing net 100.

When configured for use as a table or cot as shown in FIG. 9, portable climbing net 100 may provide a relatively flat surface that may be used as a dining table, as a storage table, cot where with or without a mattress, a bench, or in any other way a similar flat surface may be used. Portable climbing nets 1 and 100 may be configured to be used as a stretcher or device to carry large, bulky, and/or heavy items, where it may be helpful for two people to carry it with those item(s) on it. For example, if portable climbing nets 1 or 100 are expanded for use as previously described and shown in FIGS. 1 and 5, respectively, with either the top and/or bottom rails expanded and connected for use or folded and/or removed, a person may be able to carry one end by placing one hand on the left side rail or handrail and another hand on the right side rail or handrail, and second person may be able to carry the other end by placing one hand on the left side rail or handrail and another hand on the right side rail or handrail, as shown by way of example in FIG. 10 of portable climbing net 100 configured as a stretcher or device to carry bulky, large, or heavy objects.

Figure 11:
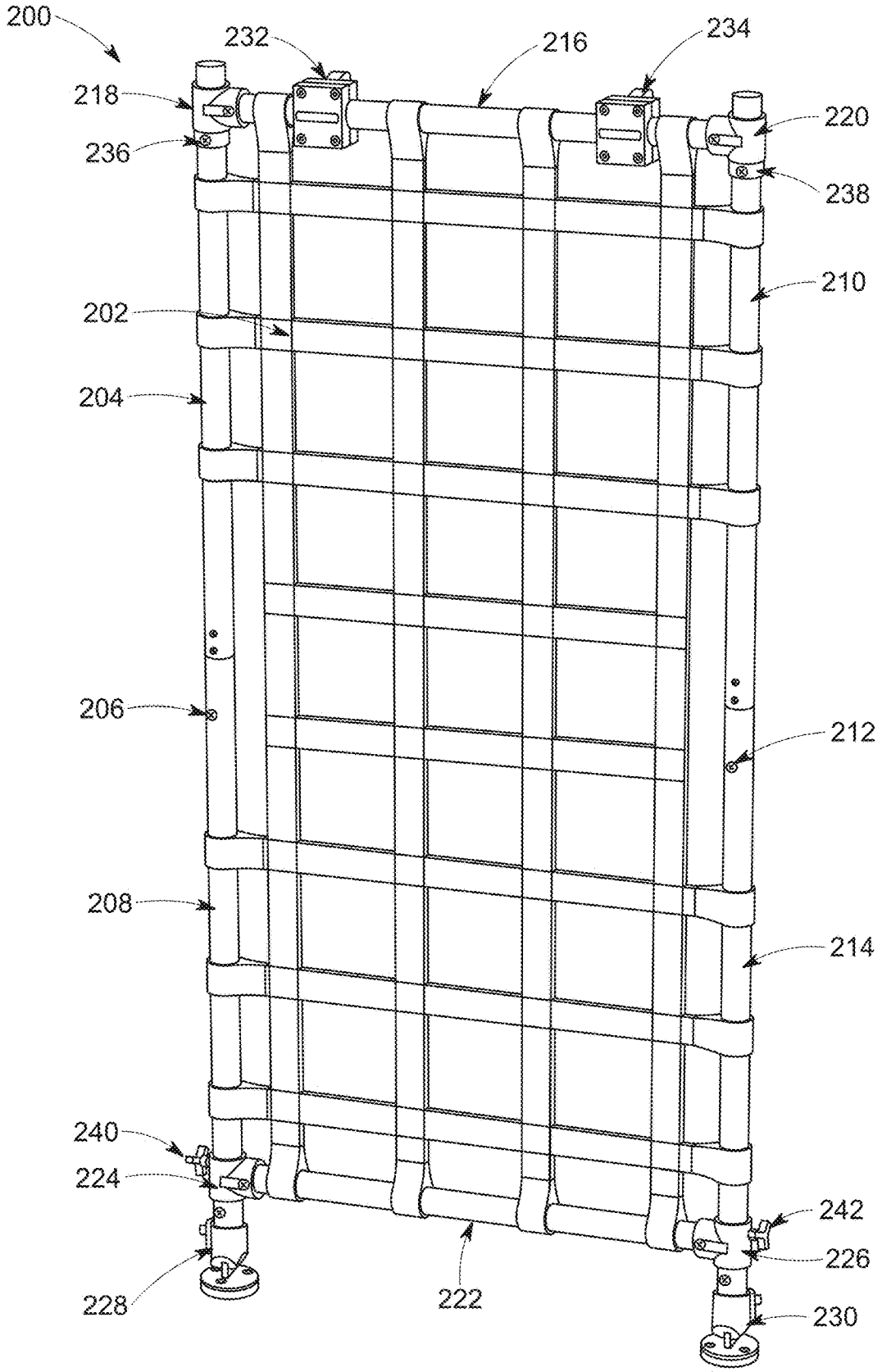
FIG. 11 shows a prospective view of another exemplary portable climbing net in an expanded configuration.
Figure 12:
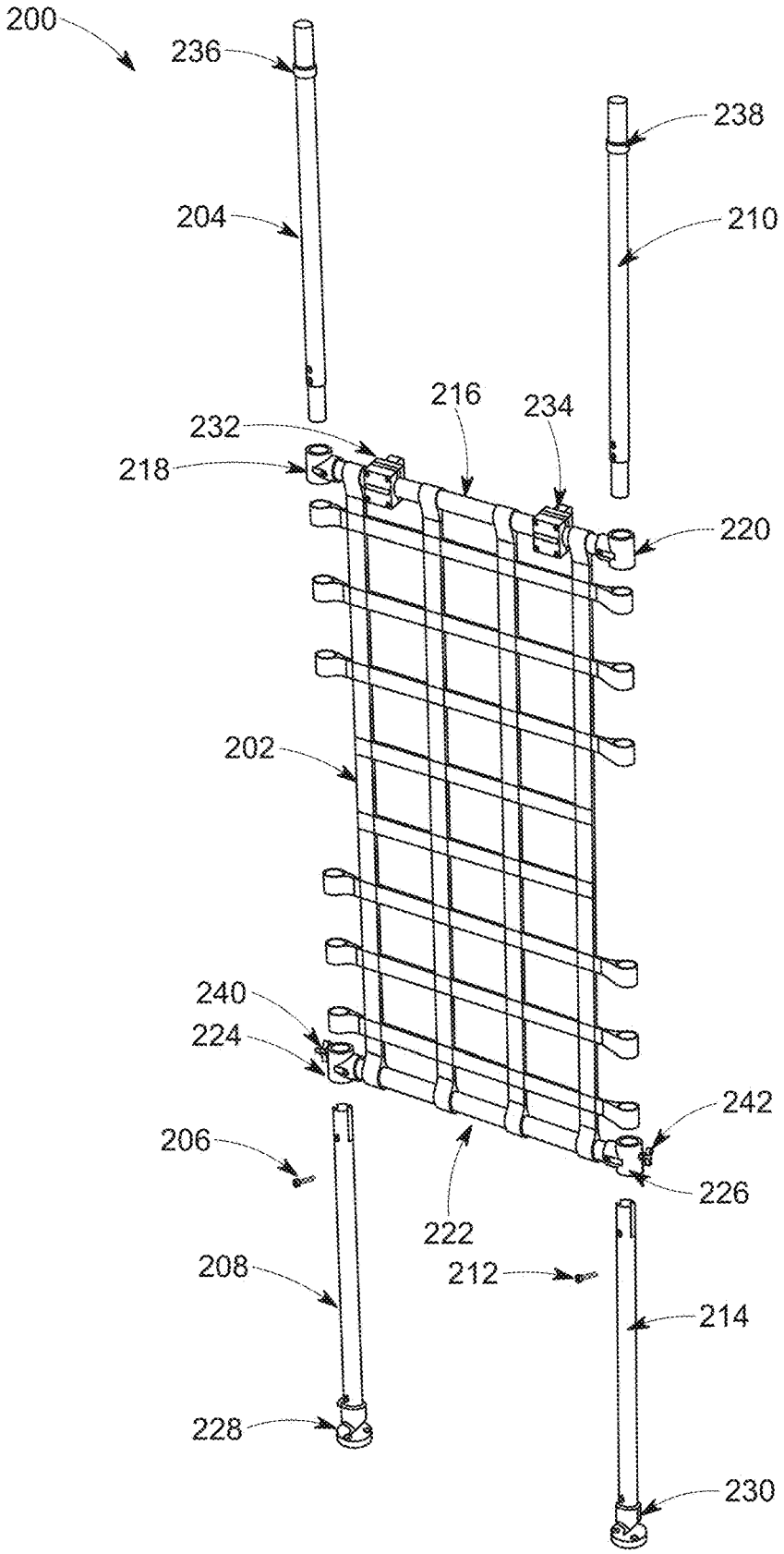
FIG. 12 shows a prospective view of the exemplary portable climbing net of FIG. 11 in a disassembled configuration.

FIG. 11 shows a prospective view of another exemplary portable climbing net, portable climbing net 200, in an expanded configuration for use and FIG. 12 shows a view of exemplary portable climbing net 200 in a disassembled view. As shown in FIGS. 11 and 12, portable climbing net 200 may be comprised of net 202, which may be like a cargo or climbing net, and components of a rigid, collapsible frame. Net 202 may be made of a strong yet flexible material commonly used in climbing and/or cargo nets and cargo straps such as nylon, polyester, Dyneema, Kevlar, plastic, rope, cables, and/or other suitable materials.

As further shown in FIGS. 11 and 12, the rigid frame of portable climbing net 200 may have a side rail or handrail on one side (i.e., the left side) which is comprised of pole 204, pin 206, and pole 208; and another side rail or handrail on an opposite side (i.e., the right side) comprised of pole 210, pin 212, and pole 214. As shown in FIGS. 11 and 12, pole 216 may comprise a top rail of portable climbing net 200. As also shown in FIGS. 11 and 12, pole 222 may comprise a bottom rail of portable climbing net 200. Poles 204, 208, 210, 214, 216, and 222 may be made of aluminum, steel, other metal, plastic, fiberglass, carbon fiber, other composite materials, wood, or other materials, or a combination of materials. Poles 204, 208, 210, 214, 216, and 222 may be solid, hollow, or have a combination of solid and hollow portions; and may be round, square, rectangular, triangular, or may be some other shape or combination of shapes. Poles 204, 208, 210, 214, 216, and 222 may each have threads, holes, notches, protrusions, indentations, collars, and/or other features located internally or externally toward one or both ends that may fit into, onto, or otherwise attach to corresponding threads, holes, notches, protrusions, indentations, collars, and/or other features located internally or externally toward one or both ends on an adjacent pole or intermediary connector that may allow quick attachment to and quick detachment of two adjacent pole sections. Some or all of the pole, pipe, or tube components that comprise the rigid frame of portable climbing net 200 may be connected through and/or to some or all loops at the ends of some or all columns and rows of net 202 or at or along other parts of net 202 by use of fasteners through grommets on net 202 (e.g., fastened to the side rails of portable climbing net 202), zip ties, ties, clamps, clips, carabiners, chain links, straps, cables, or by other methods of attaching the flexible net portion to the rigid frame, and/or they may simply slip through loops at the ends of some or all columns and rows of net 202 without being fixed (e.g., the side, top and/or bottom rails may pass through closed loops in the net). Whether some or all of the rigid frame components of portable climbing net 200 are permanently or semi-permanently fastened to net 202, not fastened at all and simply slipped through the loops in net 202, or some portions are fastened while other portions are not fastened, when all portions of the rigid frame of portable climbing net 200 are connected, unfolded, expanded, or otherwise positioned for use, net 202 may be stretched, expanded, or otherwise positioned for use as a climbing surface and portable climbing net 200 will be configured for use as shown in FIG. 11.

As shown in FIG. 11, collars 218, 220, 224, and 226 may be or may contain some or all portions of brackets, pins, screws, holes, clamps, magnets, rings, collars, threaded collars, internal or external threads, and/or other components or combination of components that may be used to quickly connect one pole, pipe, or tube perpendicularly to another pole, pipe, or tube for use or to quickly disconnect one pole, pipe, or tube from another pole, pipe, or tube for storage.

Collars 218 and 220 may have some or all components located on pole 216, which may comprise the top rail of portable climbing net 200; collars 218 and 220 may have some or all components located on poles 204 and 210, respectively, which may comprise the upper portion of the side rails of portable climbing net 200; or collar 218 may have portions located on poles 216 and 204, and/or collar 220 may have portions located on poles 216 and 210.

Some or all portions of collars 218 and 220 may be fastened to poles 216, 204, and/or 210 by pins, screws, magnets, rings, collars, threaded collars, adhesive, welding, and/or another fastening mechanism; collars 218 and 220 may be screwed directly onto or into poles 216, 204, and/or 210 (i.e., collars 218 and 220 may have internal or external threads that may be capable of screwing onto or into corresponding threads on poles 216, 204, and/or 210); or some or all portions of collars 218 and 220 may be integrated portions of poles 216, 204, and/or 210 (e.g., they may be protrusions from or sections of the poles themselves, or may be the internal or external threads on each pole capable of being screwed into or out of corresponding threads on the pole(s) to which they connect to).

As shown in FIGS. 11 and 12, collars 218 and 220 may be fixed, as described above, to the left and right sides, respectively, of pole 216. Collars 218 and 220 may temporarily connect pole 216 to poles 204 and 210, respectively, (i.e., when portable climbing net 200 is expanded for use, as shown in FIG. 11) and may be used to disconnect pole 216 from poles 204 and 210, respectively, (i.e., when portable climbing net 200 is disassembled for storage, as shown in FIG. 12) by use of pins, screws, clamps, latches, and/or magnets, by the action of screwing onto or into poles and unscrewing from poles, by the action of placing certain portions of an adjacent pole through the collar (e.g., portions of pole 204 and 210 may be placed through collars 218 and 220, respectively, on pole 216 as shown in FIG. 11), and/or another mechanism, method, or combination of mechanisms and/or methods that may be used to make quick connections and disconnections.

Collars 224 and 226 may have some or all components located on pole 222, which may comprise the bottom rail of portable climbing net 200; collars 224 and 226 may have some or all components located on poles 208 and 214, respectively, which may comprise the lower portion of the side rails of portable climbing net 200; or collar 224 may have portions located on poles 222 and 208, and/or collar 226 may have portions located on poles 222 and 214. Some or all portions of collars 224 and 226 may be fastened to poles 222, 208, and/or 214 by pins, screws, magnets, rings, collars, threaded collars, adhesive, welding, and/or another fastening mechanism; collars 224 and 226 may be screwed directly onto or into poles 222, 208, and/or 214 (i.e., collars 224 and 226 may have internal or external threads that may be capable of screwing onto or into corresponding threads on poles 222, 208, and/or 214); or some or all portions of collars 224 and 226 may be integrated portions of poles 222, 208, and/or 214 (e.g., they may be protrusions from or sections of the poles themselves, or may be the internal or external threads on each pole capable of being screwed into or out of corresponding threads on the pole(s) to which they connect to).

As shown in FIGS. 11 and 12, collars 224 and 226 may be fixed, as described above, to the left and right sides, respectively of pole 222. Collars 224 and 226 may temporarily connect pole 222 to poles 208 and 214, respectively, (i.e., when portable climbing net 200 is expanded for use, as shown in FIG. 11) and may be used to disconnect pole 222 from poles 208 and 214, respectively, (i.e., when portable climbing net 200 is disassembled for storage, as shown in FIG. 12) by use of pins, screws, clamps, latches, magnets, by the action of screwing onto or into poles and unscrewing from poles, by the action of placing certain portions of on an adjacent pole through the collar (e.g., portions of pole 208 and 214 may be placed through collars 224 and 226, respectively, on pole 222 as shown in FIG. 11), and/or another mechanism, method, and/or a combination of mechanisms and/or methods that may be used to make quick connections and disconnections.

As shown in FIG. 11, pin 206 may be a quick-release pin that connects pole 204 to pole 208 in a manner that may allow pole 204 to be connected in line with pole 208 for use of portable climbing net 200 or may allow poles 204 and 208 to be separated, as shown in FIG. 12, to facilitate disassembly of portable climbing net 200 for storage.

Similarly, and as also shown in FIG. 11, pin 212 may be a quick-release pin that connects pole 210 to pole 214 in a manner that may allow pole 210 to be connected in line with pole 214 for use of portable climbing net 200 or may allow poles 210 and 214 to be separated, as shown in FIG. 12, to facilitate disassembly of portable climbing net 200 for storage. Pins 206 and 212 may be comprised of metal, plastic, fiberglass, carbon fiber, other composite materials, other materials, or some combination of materials.

Alternatively, pins 206 and 212 may not be quick-release pins at all but, may be configured to be other types of connectors, including hinges, capable of connecting pole 204 to pole 208 and connecting pole 210 to pole 214, where the pole sections that make up each side rail or handrail either remain attached or not attached to each other when stored and may be connected together for use.

As shown in FIGS. 11 and 12, at the bottom of each side rail (i.e., the left- and right-side rails), portable climbing net 200 may contain feet that are similar to ladder feet and may be capable of pivoting or rotating to allow portable climbing net 200 to lean at various angles for use or to allow folding for storage. As shown in FIGS. 11 and 12, foot 228 may be fastened to the bottom of pole 208, and foot 230 may be fastened to the bottom of pole 214. Feet 228 and 230 may be fastened to poles 208 and 214, respectively, by pins, screws, threaded collars, adhesive, welding, and/or another fastening method, or may be screwed directly onto or into their respective poles. Feet 228 and 230 may have a relatively flat base that may have texture, groves, or tread on the bottom to allow for a non-slip, firm, or secure placement on the ground below. Feet 228 and 230 may be comprised of metal, plastic, rubber, fiberglass, carbon fiber, other composite materials, other materials, or some combination of materials. As previously mentioned, pivoting or rotating of feet 228 and 230 relative to poles 208 and 214, respectively, may allow portable climbing net 200 to lean at various angles to achieve various climbing heights or for more or less of a slope, or may also allow feet 228 and 230 to be folded flat against poles 208 and 214, respectively, for storage of portable climbing net 200. Feet 228 and 230 may also be height adjustable by use of a pin, spring-loaded button, or screw and various positioning holes on the shaft of feet 228 and 230, or by having feet whose height may be adjusted by screwing them into or out of the bottoms of the lower side poles of portable climbing net 200, as commonly found on many ladder or table feet and/or legs.

As shown in FIGS. 11 and 12, the top rail, pole 216 of portable climbing net 200 may contain brackets 232 and 234, which may further contain hooks or other components to temporarily, semi-permanently, or permanently attach portable climbing 200 onto an edge of a raised surface, onto a ladder bracket on a raised surface, or onto corresponding components on a raised surface, such as a rooftop tent or rooftop camper, a roof rack on a vehicle, or some other elevated surface. Brackets 232 and 234 may contain components that are interchangeable such that they may be removed and replaced with other components, depending on the surface to which the portable climbing net 200 is attached to or rested against. For example, hooks, pads, loops, other brackets, protrusions, or other components may be removably or interchangeably attached to brackets 232 and 234, depending on the raised surface, such that they can hook onto, rest against, loop around, and/or otherwise attach to that raised surface or corresponding components on that raised surface for temporary, semi-permanent, or permanent attachment of portable climbing net 200. Brackets 232 and 234 may be fastened to pole 216 by pins, screws, threaded collars, adhesive, welding, clamps, or another fastening method. Brackets 232 and 234 may be adjustable such that they may each slide from side to side along pole 216 to align with ladder brackets or other features at various positions on a raised surface (e.g., brackets 232 and 234 may be positioned horizontally at various positions along pole 216 to align with the positions of ladder brackets on a roof top tent or other raised surface). Brackets 232 and 234 may be comprised of metal, plastic, rubber, fiberglass, carbon fiber, other composite materials, other materials, or some combination of materials. Alternatively, the tops of the side rails, poles 204 and 210 (i.e., the left- and right-side rails, respectively) of portable climbing net 200, may contain brackets 232 and 234, respectively, attached to them rather than to pole 216.

As shown in FIGS. 11 and 12, portable climbing net 200 may contain collars 236 and 238. Like collars 218, 220, 224, and 226, collars 236 and 238 may contain some or all portions of brackets, pins, screws, holes, clamps, threaded collars, internal or external threads, magnets, and/or other components or combination of components that may be used to complete a connection of or further secure one pole, pipe, or tube perpendicularly to another pole, pipe, or tube for use or to quickly disconnect one pole, pipe, or tube from another pole, pipe, or tube for disassembly and storage. Collars 236 and 238 may have some or all components located on poles 204 and 210, respectively, which may comprise the upper portion of the side rails of portable climbing net 200, as shown in FIGS. 11 and 12; collars 236 and 238 may have some or all components located on pole 216, which may comprise the top rail of portable climbing net 200; or collar 236 may have portions located on poles 204 and 216, and/or collar 238 may have portions located on poles 210 and 216. Some or all portions of collars 236 and 238 may be fastened to poles 204, 210, and/or 216 by pins, screws, threaded collars, adhesive, welding, and/or another fastening mechanism; collars 236 and 238 may be screwed directly onto or into poles 204, 210, and/or 216 (i.e., collars 236 and 238 may have internal or external threads that may be capable of screwing onto or into corresponding threads on poles 204, 210, and/or 216); or some or all portions of collars 236 and 238 may be integrated portions of poles 204, 210, and/or 216 (e.g., they may be protrusions from or indentations in or sections of the poles themselves, or may be the internal or external threads on each pole capable of being screwed into or out of corresponding threads on the pole(s) to which they connect to). As shown in FIG. 11, collars 236 and 238 on poles 204 and 210, respectively, may be used to prevent collars 218 and 220, respectively, on pole 216 from sliding down (e.g., collars 218 and 220 may be wide enough to fit around poles 204 and 210, respectively, however may not be wide enough to fit around or go past collars 236 and 238, respectively) such that pole 216 is held in place when portable climbing net 200 is assembled for use, as shown in FIG. 11. Collars 236 and 238 may contain magnets to temporarily attach them to collars 218 and 220, respectively, to aide in assembly of portable climbing net 200, if the climbing net was assembled while in a relatively vertical position, as described further below.

As shown in FIGS. 11 and 12, portable climbing net 200 may contain screws 240 and 242 which may be used to complete connection of or further secure one pole, pipe, or tube perpendicularly to another pole, pipe, or tube for use or to quickly disconnect one pole, pipe, or tube from another pole, pipe, or tube for disassembly and storage. Screws 240 and 242 may be set screws with a knob to turn them, as shown in FIGS. 11 and 12. Screws 240 and 242 may have some or all components located on collars 224 and 226, which may comprise collars on the left and right sides, respectively, of pole 222, as shown in FIGS. 11 and 12; screws 240 and 242 may have some or all components located on pole 222, which may comprise the bottom rail of portable climbing net 200; screws 240 and 242 may have some or all components located on poles 208 and 214, respectively, which may comprise the lower portion of the side rails of portable climbing net 200; or screw 240 may have portions located on collar 224 and poles 208 and 222, and/or screw 242 may have portions located on collar 226 and poles 214 and 222. Some or all portions of screws 240 and 242 may be fastened to collars 224 and 226, respectively, and/or poles 208, 214, and/or 222 by pins, screws, threaded collars, adhesive, welding, and/or another fastening mechanism; screws 240 and 242 may be screwed directly onto, into, or through collars 224 and 226, respectively, poles 208 and 214, respectively, and/or pole 222 (i.e., screws 240 and 242 may have internal or external threads that may be capable of screwing onto or into corresponding threads on collars 224 and 226, respectively, poles 208 and 214, respectively, and/or pole 222); or some or all portions of screws 240 and 242 or corresponding features that accept the screws may be integrated portions of collars 224 and 226, respectively, poles 208 and 214, respectively, and/or pole 222 (e.g., they may be indentations or grooves in the poles themselves capable of accepting a screw, like a set screw).

To assemble portable climbing net 200 for use as shown in FIG. 11, net 202 may be unrolled or removed from its stored position; pole 216 may be passed through some or all loops at the top of net 202, as shown in FIGS. 11 and 12; pole 222 may be passed through some or all loops at the bottom of net 202, as shown in FIGS. 11 and 12; brackets 232 and 234 may be attached to pole 216, shown in FIGS. 11 and 12; poles 204 and 210 may be passed first through some or all of the loops on the left and right sides, respectively, of the upper portion of net 202 then through collars 218 and 220, respectively, as shown in FIG. 11; poles 208 and 214 may be passed first through collars 224 and 226, respectively, then through some or all of the loops on the left and right sides, respectively, of the lower portion of net 202, as shown in FIG. 11; poles 204 and 210 may then be connected to poles 208 and 214, respectively, and secured by pins 206 and 212, respectively, as shown in FIG. 11. Portable climbing net 200 may then be positioned for use, with feet 228 and 230 placed on a lower or bottom surface, and with brackets 232 and 234 hooking onto, resting against, or otherwise attaching to an upper or raised surface, such that portable climbing net 200 is in an upright position. When portable climbing net 200 is positioned in an upright position for use, as shown in FIG. 11, collars 236 and 238, which may be fixed to poles 204 and 210, respectively, may prevent collars 218 and 220, respectively, which may both be fixed to the left and right sides, respectively, of pole 216, from sliding down poles 204 and 210, respectively (i.e., the diameter of collars 236 and 238 may be as wide or wider than the diameter of collars 218 and 220, respectively, such that pole 216 may be prevented from sliding down poles 204 and 210, respectively). This configuration may keep net 202 stretched taut between the poles that make up the left side rail (i.e., poles 204 and 208), the poles that make up the right side rail (i.e., poles 210 and 214), the top rail (i.e., pole 216), and the bottom rail (i.e., pole 222) to allow a person to climb up or down portable climbing net 200. If desired, screws 240 and 242 may be screwed through collars 224 and 226, respectively, and onto holes, groves, or the surface of poles 208 and 214, respectively, such that pole 222 is held in position, preventing net 202 from moving or moving substantially, when a person climbs up or down net portable climbing net 200.

To disassemble portable climbing net 200 for storage, as shown in FIG. 12, the rigid frame components may be disconnected and separated in the following order: if screws 240 and 242 are tightened, they may be loosened; pins 206 and 212 may then be disconnected and removed such that poles 204 and 210 can be separated from poles 208 and 214, respectively; then poles 208 and 214 may be pulled down and out of the loops in left and right sides, respectively, of the lower portion of net 202, then down and out of collars 224 and 226, respectively; then poles 204 and 208 may be pulled down and out of collars 218 and 220, respectively, then pulled down and out of the loops in the left and right sides, respectively, of the upper portion of net 202. Pole 216 along with collars 218 and 222, and brackets 232 and 234; and pole 222 along with collars 224 and 226, and screws 240 and 242 may be left attached to net 202, as shown in FIG. 12, for case of disassembly and reassembly, and poles 204, 208, 210, and 214 may be laid laterally, across net 202, so that all poles may be rolled into net 202 for storage.

Some or all the components of portable climbing net 200 may be the same as or interchangeable across the other embodiments of portable climbing nets previously discussed (i.e., portable climbing net 1 and portable climbing net 100) and all three embodiments of climbing nets may have features that are the same, similar, or different. For example, the poles, hinges, connectors, collars, feet, brackets, hooks, nets, straps, and other components may be the same, similar, or different across all three embodiments and may offer the same, similar, or different features.

All embodiments of portable climbing net may also be configured to have more or fewer rigid frame sections that may be combined with longer or shorter nets which may allow each embodiment of portable climbing net to be taller and reach greater heights and/or shorter when stored. For example, more pole sections on the side rails or handrails of portable climbing nets 1, 100, and 200 may increase the length of the portable climbing nets' side rails or handrail and combined with a longer net may allow the portable climbing nets to be taller. More and shorter pole sections on the side rails or handrails of portable climbing nets 1, 100, and 200 may decrease the stored length of the portable climbing nets' side rails or handrails which may allow the portable climbing nets to be shorter when stored. Increased lengths of the top and bottom rails of portable climbing nets 1, 100, and 200 combined with a wider net may allow the portable climbing nets to be wider when configured for use; and decreased lengths of the top and bottom rails of portable climbing nets 1, 100, and 200 combined with a narrower net may allow the portable climbing nets to be narrower when configured for use.

As previously described and shown for portable climbing nets 1 and 100, alternative uses of portable climbing net 200 may be achieved with additional components and/or additional configurations. For example, if portable climbing net 200 is positioned horizontally and combined with additional connectors, collars, poles, and/or feet that may be added to the side, top, and/or bottom rails of portable climbing net 200, it may be used as table and/or cot, similar to what was previously shown for portable climbing net 100 in FIG. 9 (i.e., FIG. 9 showed portable climbing net 100 configured for use as a table or cot, however, similar components may be added to portable climbing net 200 and it may be similarly configured for use as a table and/or cot).

Portable climbing net 200 may be expanded as discussed previously and shown in FIG. 11, however, it may be positioned horizontally and combined with additional poles that may serve as legs; additional connectors or collars to connect those poles to the side, top, and/or bottom rails (i.e., poles 204, 208, 210, 214, 216, and/or 222 shown previously in FIGS. 11 and 12); and additional feet on the additional poles for secure, horizontal placement of portable climbing net 200 on a surface, similar to what was shown by way of example with portable climbing net 100 in FIG. 9. When configured for use as a table or cot, portable climbing net 200 may provide a relatively flat surface that may be used as a dining table; as a storage table; cot, with or without a mattress; a bench, or in any other way a similar flat surface may be used. Portable climbing net 200 may also be configured to be used as a stretcher or device to carry large, bulky, and/or heavy items, where it may be helpful for two people to carry it with those item(s) on it.

Figure 10:
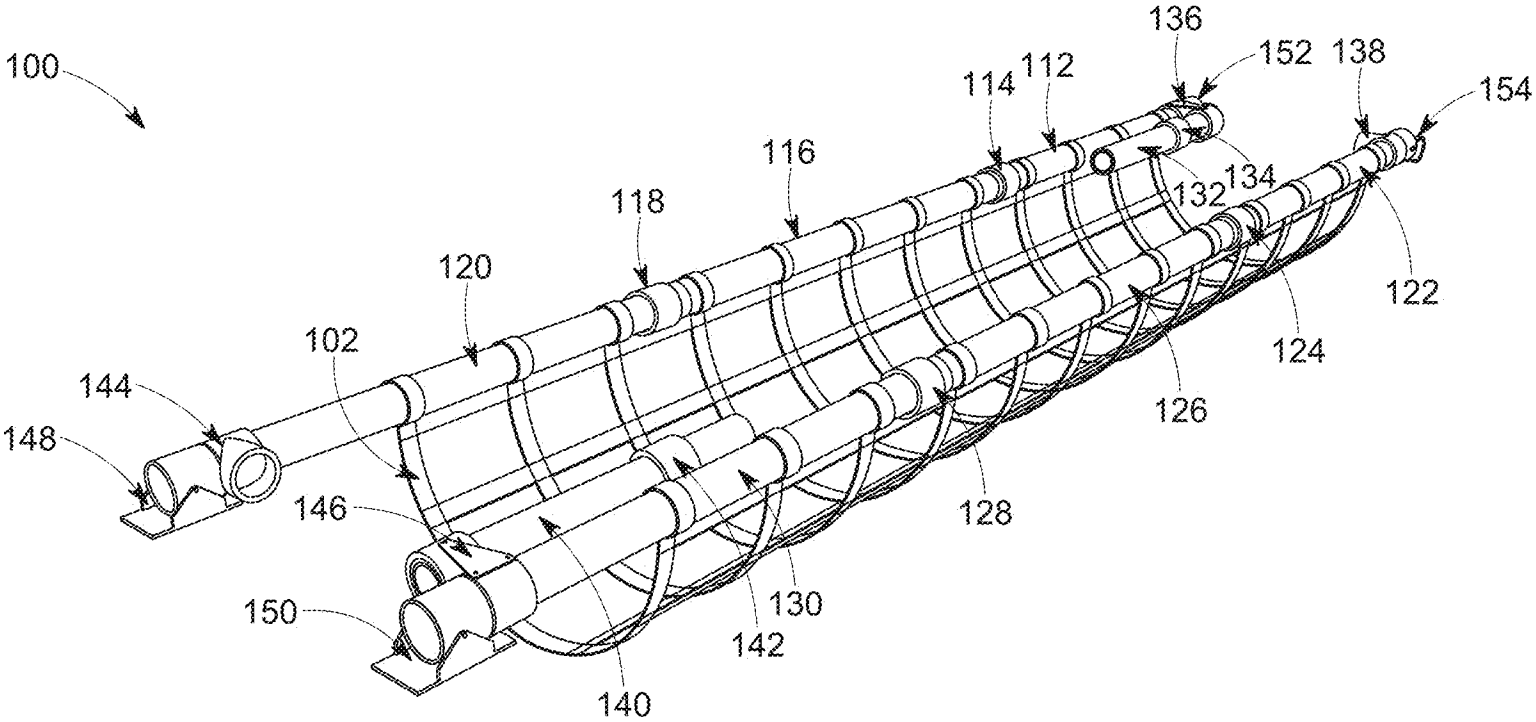
FIG. 10 shows the exemplary portable climbing net of FIG. 5 configured for use as a stretcher or to transport heavy and/or bulky items.

For example, if portable climbing net 200 is expanded for use, respectively, with either the top and/or bottom rails in place or not, and any permanently or semi-permanently connected components (i.e., poles 216 and 222, collars 218 and 220, respectively and collars 224 and 226, respectively; brackets 232 and 234 on pole 216, and screws 240 and 242, respectively) connected for use or alternatively, removed (i.e., portable climbing net 200 only contains net 202; poles 204, 208, 210, and 214, pin 206 connecting poles 204 and 208, pin 212 connecting poles 210 and 212, and, optionally, any components permanently or semi-permanently connected to the poles such as feet 228 and 230 on poles 208 and 214, respectively, and collars 236 and 238 on poles 204 and 208, respectively), a person may be able to carry one end by placing one hand on the left side rail or handrail and another hand on the right side rail or handrail, and second person may be able to carry the other end by placing one hand on the left side rail or handrail and another hand on the right side rail or handrail, similar to what was shown by way of example with portable climbing net 100 in FIG. 10. In this configuration portable climbing net 200 may be used as a stretcher or device to carry bulky, large, or heavy objects.

What is claimed is:

1. A collapsible portable climbing net comprising:

a left lateral pole comprising a first lateral pole and a second lateral pole, the first lateral pole and the second lateral pole being separable from each other;

a right lateral pole comprising a third lateral pole and a fourth lateral pole, the third lateral pole and the fourth lateral pole being separable from each other;

a top pole comprising a first collar and a second collar;

a bottom pole comprising a third collar and a fourth collar; and a net secured between the left lateral pole and the right lateral pole and between the top pole and the bottom pole, wherein the first lateral pole is configured to pass through the first collar, and the third lateral pole is configured to pass through the second collar, wherein the second lateral pole is configured to pass through the third collar, and the fourth lateral pole is configured to pass through the fourth collar, wherein the first lateral pole comprises a first stop collar having a size that prevents the first collar from passing over the first stop collar to thereby prevent the top pole from sliding down along the first lateral pole when assembled, wherein the third lateral pole comprises a second stop collar having a size that prevents the second collar from passing over the second stop collar to thereby prevent the top pole from sliding down along the third lateral pole when assembled, and wherein the top pole further comprises a bracket configured to attach the collapsible portable climbing net to an object, wherein the bracket is positioned between the first collar and the second collar.

2. The collapsible portable climbing net of claim 1, wherein the net comprises at least one lateral loop that is configured to be passed through by at least one of the first lateral pole, the second lateral pole, the third lateral pole, and the fourth lateral pole.

3. The collapsible portable climbing net of claim 1, wherein the net comprises at least one longitudinal loop that is configured to be passed through by at least one of the top pole and the bottom pole.

4. The collapsible portable climbing net of claim 1, wherein at least one of the first collar, the second collar, the third collar, and the fourth collar comprises a screw configured to further secure connection with the left lateral pole or the right lateral pole, wherein the screw is configured to inhibit relative movement between the at least one collar and the corresponding lateral pole while the net is tensioned.

5. The collapsible portable climbing net of claim 4, wherein the screw comprises a knob.

6. The collapsible portable climbing net of claim 1, further comprising a connector between the first lateral pole and the second lateral pole.

7. The collapsible portable climbing net of claim 6, wherein the connector is a pin or a hinge.

8. The collapsible portable climbing net of claim 1, further comprising a connector between the third lateral pole and the fourth lateral pole.

9. The collapsible portable climbing net of claim 8, wherein the connector is a pin or a hinge.

10. The collapsible portable climbing net of claim 1, wherein the top pole further comprises more than one bracket configured to attach the collapsible portable climbing net to a surface, and wherein the net comprises at least one longitudinal loop that is configured to be passed through by at least one of the top pole and the bottom pole and be positioned between the one or more brackets.

11. The collapsible portable climbing net of claim 1, wherein the first lateral pole and the third lateral poles, respectively, comprises a bracket configured to attach the collapsible portable climbing net to an object.

12. The collapsible portable climbing net of claim 1, further comprising a left foot pole coupled proximate a lower end of the left lateral pole and a right foot pole coupled proximate a lower end of the right lateral pole.

13. The collapsible portable climbing net of claim 12, wherein each of the left foot pole and the right foot pole is pivotable or rotatable.

14. The collapsible portable climbing net of claim 12, wherein each of the left foot pole and the right foot pole is height-adjustable.

15. The collapsible portable climbing net of claim 12, wherein each of the left foot pole and the right foot pole terminates in a foot having a base configured to engage a supporting surface.

16. The collapsible portable climbing net of claim 1, wherein the net comprises lateral rows and longitudinal columns.

17. The collapsible portable climbing net of claim 1, wherein at least one of the first collar, the second collar, the third collar, and the fourth collar comprises a bracket, a pin, a screw, a hole, a clamp, a magnet, a ring, a collar, a threaded collar, an internal or external thread.

* * * * *